US006703772B2

(12) United States Patent
Hasegawa et al.

(10) Patent No.: US 6,703,772 B2
(45) Date of Patent: Mar. 9, 2004

(54) PLASMA DISPLAY PANEL WITH AN IMPROVED ELECTRODE STRUCTURE

(75) Inventors: Hiroshi Hasegawa, Tokyo (JP); Nobumitsu Aibara, Tokyo (JP); Naoto Hirano, Tokyo (JP); Tadashi Nakamura, Tokyo (JP); Yoshito Tanaka, Tokyo (JP); Hajime Homma, Tokyo (JP); Kota Araki, Tokyo (JP)

(73) Assignee: NEC Corporation, Tokyo (JP)

( * ) Notice: Subject to any disclaimer, the term of this patent is extended or adjusted under 35 U.S.C. 154(b) by 21 days.

(21) Appl. No.: 10/100,034

(22) Filed: Mar. 19, 2002

(65) Prior Publication Data

US 2002/0130618 A1 Sep. 19, 2002

(30) Foreign Application Priority Data

Mar. 19, 2001 (JP) ..... 2001-078558

(51) Int. Cl.[7] ..... H01J 17/49
(52) U.S. Cl. ..... 313/384; 313/583; 313/585
(58) Field of Search ..... 313/582, 583, 313/584, 585, 586, 587, 326; 345/60; 315/169.1, 169.3; 445/24, 25, 50, 51

(56) References Cited

U.S. PATENT DOCUMENTS

| | | | | |
|---|---|---|---|---|
| 6,376,986 | B1 * | 4/2002 | Takagi et al. | 313/582 |
| 6,400,081 | B1 * | 6/2002 | Matsumoto et al. | 313/582 |
| 6,522,072 | B1 * | 2/2003 | Yura et al. | 313/582 |
| 2002/0063524 | A1 * | 5/2002 | Nakamura et al. | 313/582 |

FOREIGN PATENT DOCUMENTS

| | | |
|---|---|---|
| JP | 10-302643 A | 11/1998 |
| JP | 2000-123748 A | 4/2000 |

* cited by examiner

*Primary Examiner*—Edward J. Glick
*Assistant Examiner*—Elizabeth Gemmell
(74) *Attorney, Agent, or Firm*—Sughrue Mion, PLLC

(57) ABSTRACT

A plasma display panel has an improved cell electrode structure including: a pair of sustaining and scanning electrodes which are approximately similar or equal in area to each other, and which are different from each other in pattern shape. Each of the scanning electrode alignments further includes a plurality of scanning electrodes. Adjacent two of the scanning electrodes are separated from each other by the separation wall. Each of the sustaining electrode alignments further includes a plurality of sustaining electrodes. Adjacent two of the sustaining electrodes are separated from each other by the separation wall.

34 Claims, 19 Drawing Sheets

PLASMA DISPLAY PANEL WITH AN IMPROVED ELECTRODE STRUCTURE

BACKGROUND OF THE INVENTION

1. Field of the Invention

The present invention relates to a plasma display panel, and more particularly to an alternating current surface discharge plasma display panel having an asymmetrical plane electrode structure.

2. Description of the Related Art

The plasma display panel has been known as a thin flat screen display device having a large screen size and a large capacity. Electrons are accelerated by an electric field so that the accelerated electrons have collisions to a discharge gas to cause excitation and subsequent relaxation. This relaxation process causes radiation of an ultraviolet ray. The ultraviolet ray is irradiated onto a fluorescent material, whereby the ultraviolet ray is converted into a visible light. The alternating current plasma display panel is generally superior in luminance, luminous efficiency and operational life-time than the direct current plasma display panel.

FIG. 1 is a perspective view illustrative of a panel structure of a conventional alternating current surface discharge memory type plasma display panel. FIG. 2 is a cross sectional elevation view illustrative of a display cell structure of the conventional alternating current surface discharge memory type plasma display panel of FIG. 1. FIG. 3 is a fragmentary plane view illustrative of the display cell structure of FIG. 2.

The conventional plasma display panel has a front side insulative substrate 1 and a back side insulative substrate 2. A plurality of scanning electrodes 3 and a plurality of sustaining electrodes 4 are provided on an inside face of the front side insulative substrate 1. The scanning electrodes 3 and the sustaining electrodes 4 are alternately aligned at a predetermined pitch in a first horizontal direction. The scanning electrodes 3 and the sustaining electrodes 4 have stripe shapes. The scanning electrodes 3 and the sustaining electrodes 4 extend in parallel to each other and in a second horizontal direction which is perpendicular to the first horizontal direction.

A plurality of first bus electrodes 5 are laminated on the scanning electrodes 3 for reducing an electrode resistance. The first bus electrodes 5 also have a stripe shape and extends along the scanning electrodes 3. The first bus electrodes 5 have a smaller width than the scanning electrodes 3. Each of the first bus electrodes 5 is aligned to one long side of each of the scanning electrodes 3. A plurality of second bus electrodes 6 are laminated on the sustaining electrodes 4 for reducing an electrode resistance. The second bus electrodes 6 also have a stripe shape and extends along the sustaining electrodes 4. The second bus electrodes 6 have a smaller width than the sustaining electrodes 4. Each of the second bus electrodes 6 is aligned to one long side of each of the sustaining electrodes 4.

A plurality of data electrodes 7 are provided on an inside face of the back side insulative substrate 2. The data electrodes 7 are aligned at a predetermined constant pitch in the second horizontal direction. The data electrodes 7 have a stripe shape. The data electrodes 7 extend in parallel to each other and in the first horizontal direction which is perpendicular to the second horizontal direction along which the scanning electrodes 3 and the sustaining electrodes 4 extend.

A discharge gas is filled within an inter-space 8 defined between the front side insulative substrate 1 and the back side insulative substrate 2. The discharge gas may be a helium gas, a neon gas, a xenon gas or a mixture gas thereof.

A first dielectric layer 10 is provided on the inside face of the front side insulative substrate 1, so that the scanning electrodes 3, the sustaining electrodes 4, the first bus electrodes 5 and the second bus electrodes 6 are buried in the first dielectric layer 10. A protection layer 11 is provided on an inside face of the first dielectric layer 10 for protecting the dielectric layer 10 from the discharge. The protection layer 11 may optically comprise magnesium oxide.

A second dielectric layer 12 is provided on the inside face of the back side insulative substrate 2, so that the data electrodes 7 are buried in the first dielectric layer 10. A plurality of separation walls 13 are provided on an inside face of the second dielectric layer 12. The separation walls 13 extend in straight in parallel to each other and in the first horizontal direction, so that the separation walls 13 extend in parallel to the data electrodes 7. In the plane view vertical to the surface of the back side insulative substrate 2, each of the separation walls 13 is positioned between adjacent two of the data electrodes 7, so that each of the data electrodes 7 is positioned under each gap defied between adjacent two of the separation walls 13. The separation walls 13 define plural display cell regions, wherein each of the separation walls 13 separates adjacent two of the plural display cell regions.

A fluorescent material 9 is applied on exposed regions of the inner face of the second dielectric layer 12 and side walls of the separation walls 13, wherein the exposed regions of the inner face of the second dielectric layer 12 are exposed to the plural display cell regions defined by the separation walls 13. The fluorescent material 9 includes two dimensional arrays of three primary colors. The discharge gas generates the ultraviolet ray which is then irradiated onto the fluorescent material 9, whereby the fluorescent material 9 shows the luminescence in accordance with the three primary colors, and a visible light 14 is emitted from an outside surface of the front side insulative substrate 1.

With reference to FIG. 2, the discharge operation of the conventional plasma display panel will be described. A pulse voltage higher than a discharge threshold voltage level is applied across the scanning electrodes 3 and the data electrodes 7 to cause a discharge between the scanning electrodes 3 and the data electrodes 7. In accordance with the polarity of the applied pulse voltage, positive charges and negative charges are forced to move in opposite directions to each other and then accumulated onto respective ones of the first and second dielectric layers 10 and 12.

Equivalent internal voltage or wall voltage causing the respective accumulations of the positive charges and the negative charges has an opposite polarity to the applied pulse voltage, for which reason as the discharge time increases, the effective voltage level in the cell gradually decreases even the applied pulse voltage level remains kept at the constant level. The gradual decease of the effective voltage level results in no longer possible of sustaining the discharge, whereby the discharge will be discontinued in the course of time.

The primary discharge between the scanning electrodes 3 and the data electrodes 7 is caused under another voltage application between the scanning electrodes 3 and the sustaining electrodes 4, so that the primary discharge between the scanning electrodes 3 and the data electrodes 7 serves as a trigger to cause a secondary discharge between the scanning electrodes 3 and the sustaining electrodes 4. This secondary discharge between the scanning electrodes 3 and the sustaining electrodes 4 causes additional respective accumulations of the positive charges and the negative charges on the first dielectric layer 10 such as to cancel the applied voltage.

Subsequently, a sustaining pulse voltage having the same polarity as the wall voltage is further applied between the scanning electrodes 3 and the sustaining electrodes 4, whereby the sustaining pulse voltage is superimposed with the wall voltage. If an amplitude of the sustaining pulse voltage is smaller than the threshold level, the discharge is caused between the scanning electrodes 3 and the sustaining electrodes 4, provided that the effective voltage level as the superimposition of the applied sustaining pulse voltage with the wall voltage is higher than the threshold voltage level. The sustaining pulse voltage is alternately applied between the scanning electrodes 3 and the sustaining electrodes 4, whereby the discharge is sustained. This physical phenomenon corresponds to the memory function.

FIG. 4 is a block diagram illustrative of an entire configuration of the plasma display device including the plasma display panel including a matrix array of the display cell shown in FIG. 2. The plasma display device has a plasma display panel 15. The plasma display panel 15 comprises a dot-matrix array of "mxn" of the display cell 16, a plurality of scanning electrodes X1, X2, . . . , Xm extending in the row direction, and a plurality of sustaining electrodes Y1, Y2, . . . , Ym extending in the row direction, and further a plurality of data electrodes D1, D2, . . . Dn extending in the column direction. Namely, the row electrodes comprise the scanning electrodes X1, X2, . . . , Xm and the sustaining electrodes Y1, Y2, . . . , Ym. The column electrodes comprise the data electrodes D1, D2, . . . Dn.

The plasma display device further includes a scanning driver 17 for applying scanning electrode driving voltages to the scanning electrodes X1, X2, . . . , Xm. The plasma display device furthermore includes a sustaining driver 18 for applying sustaining electrode driving voltages to the sustaining electrodes Y1, Y2, . . . , Ym. The plasma display device moreover includes a data driver 19 for applying data electrode driving voltages to the data electrodes D1, D2, . . . Dn.

The plasma display device also includes a control circuit 20 for generating a scanning driver control signal for controlling the scanning driver 17, and a sustaining driver control signal for controlling the sustaining driver 18, as well as a data driver control signal for controlling the data driver 19 based on externally-inputted basic signals, for example, a vertical synchronizing signal Vcync, a horizontal synchronizing signal Hcync, a clock signal Clock and a data signal DATA.

The control circuit 20 further includes a frame memory 20*a*, a signal processing memory controlling circuit 20*b* and a driver control circuit 20*c*. The frame memory 20*a* stores data signals as image data. The signal processing memory controlling circuit 20*b* receives the externally-inputted basic signals and generates respective controls signals for controlling the frame memory 20*a* and the driver control circuit 20*c*. The driver control circuit 20*c* generates the scanning driver control signal for controlling the scanning driver 17, and the sustaining driver control signal for controlling the sustaining driver 18, as well as the data driver control signal for controlling the data driver 19.

FIG. 5 is a diagram illustrative of waveforms of scanning electrode driving voltages, sustaining electrode driving voltage and data electrode driving voltage in connection with the plasma display device of FIG. 4. "Wu" represents the sustaining electrode driving voltage which is commonly applied to the sustaining electrodes Y1, Y2, . . . , Ym. "Ws1", "Ws2", . . . "Wsm" represent the scanning electrode driving voltages which are respectively applied to the scanning electrodes X1, X2, . . . , Xm. "Wd" represents the data electrode driving voltage which is applied to selected one of the data electrodes D1, D2, . . . Dn.

One sub-field corresponds to the one driving cycle. The one sub-field comprises, in the order, a preliminary discharge term "Tp", a writing discharge term "Tw", a sustaining discharge term "Ts" and an erasing discharge term "Te".

The preliminary discharge term "Tp"is a term for generating activated particles and wall charges in the discharge gas space 8 for the purpose of obtaining a stable write discharge characteristic in the next write discharge term. After a preliminary discharge pulse "Pp" has been applied to cause simultaneous discharges in all of the display cells of the plasma display panel, then a preliminary discharge erasing pulse "Pep" is also simultaneously applied to the scanning electrodes for erasing undesirable charges in the generated wall charges, provided that the undesirable charges may prevent the write discharge and the sustaining discharge.

For example, the preliminary discharge pulse Pp is simultaneously applied to the scanning electrodes X1, X2, . . . , Xm to cause the simultaneous discharges in all of the display cells, before the sustaining electrodes Y1, Y2, . . . , Ym are risen in voltage up to a sustaining voltage level Vs. In order to gradually drop the potential of the sustaining electrodes Y1, Y2, . . . , Ym, the preliminary discharge erasing pulse "Pep" is applied to the scanning electrodes X1, X2, . . . , Xm for causing an erasing discharge which erase the wall charges or reduces the quantity of the wall charges, wherein the wall charges had been accumulated by the preliminary discharge pulse Pp. The reduction in the quantity of the wall charges has to be made so that the reduced quantity of the wall charges does not prevent the subsequent write discharge and the sustaining discharge.

In the writing discharge term "Tw", scanning pulses "Pw" are sequentially applied to the scanning electrodes X1, X2, . . . , Xm and also in synchronizing with the scanning pulse "Pw", a data pulse "Pd" is selectively applied to a selected data electrode "Di" ($1 \leqq i \leqq n$) of the selected display cell for display, thereby causing the write discharge in the selected cell for the display, and this caused write discharge generates the wall charges.

In the sustaining discharge term "Ts", sustaining pulses Pc are applied to the sustaining electrodes Y1, Y2, . . . , Ym, and also phase-delay sustaining pulses Ps, which are delayed in phase by 180 degrees from the sustaining pulses Pc, are applied to the scanning electrodes X1, X2, . . . , Xm, so as to cause a sustaining discharge in the selected display cell for obtaining a desired brightness or luminance, wherein the selected display cell had the write discharge in the writing discharge term "Tw".

In the erasing discharge term "Te", erasing pulses Pe are applied to the scanning electrodes X1, X2, . . . , Xm to gradually drop the potentials of the scanning electrodes X1, X2, . . . , Xm, so as to cause the erasing discharge, thereby erasing the wall charges or reducing the quantity of the wall charges, wherein the wall charges had accumulated by he sustaining discharge pulse. The reduction in the quantity of the wall charges has to be made so that the reduced quantity of the wall charges does not prevent the subsequent preliminary discharge in the next preliminary discharge term "Tp" and the writing discharge in the next writing discharge term "Tw" as well as the sustaining discharge in the next sustaining discharge term "Ts" in the next cycle.

In the writing discharge term "Tw", an opposite discharge between the scanning electrode and the data electrode is likely to be caused. This opposite discharge triggers a surface discharge between the scanning electrodes and the sustaining electrodes. If the opposite discharge and the surface discharge are stable, then input images are correctly displayed. The opposite discharge means the write discharge. The surface discharge means the sustaining discharge.

Japanese laid-open patent publication No. 10-302643 discloses that, in order to obtain a desirable high stability of the write discharge, a width of the scanning electrodes is made narrower than a width of the sustaining electrodes. FIG. 6 is a cress sectional elevation view illustrative of another conventional display cell structure of the plasma display panel disclosed in the above Japanese publication. The conventional display cell structure of FIG. 6 is applied to substantially the same structure as shown in FIG. 1. As shown in FIG. 6, the scanning electrode 3 is smaller in width than the sustaining electrode 4 in order to reduce an overlapping area between the scanning electrode 3 and the data electrode 7. The reduction in the overlapping area between the scanning electrode 3 and the data electrode 7 reduces the likelihood of causing the surface discharge.

The above-described different kinds of the electrodes are different in those roles and also required to have different performances and characteristics. For example, the data electrodes to be applied with signal pulses are required to have such characteristics as to certainly cause the write discharge between the data electrodes and the scanning electrodes, thereby forming a sufficient quantity of the wall charges on the plane electrode in the vicinity of the surface discharge gap.

The scanning electrodes to be applied with the write pulses are required to have such characteristics as to certainly cause the write discharge between the data electrodes and the scanning electrodes, thereby forming the sufficient quantity of the wall charges on the plane electrode in the vicinity of the surface discharge gap, and further additional characteristics so as to allow a prompt transition from the write discharge into the sustaining discharge.

The sustaining electrodes to be applied with the sustaining pulses are required to have such characteristics as to allow a stable and continuous sustaining discharge between the sustaining electrodes and the scanning electrodes.

Not only the surface discharge or the sustaining discharge but also the opposite discharge or the write discharge are likely to be caused in the vicinity of the edge of the surface electrode making the surface discharge gap, dependent upon various factors, for example, the cell structure, the waveforms of the driving voltage pulses and the triggering function due to the electric field strain at the edge of the surface electrodes.

If the write discharge in the vicinity of the edges of the surface electrodes is essential without any unnecessary discharge at the unnecessary region, then this contributes to cause the subsequent sustaining discharge. As a result, the operational margin is made wide and the display quality is improved.

If the write voltage or the potential difference between the data electrodes and the scanning electrodes is low, then it is possible that the write discharge is caused only in the vicinity of the edges of the surface electrodes. Notwithstanding, this write discharge is a weak discharge having a low degree of ionization, thereby forming an insufficient quantity of the wall charges for prompt transition from the write discharge to the sustaining discharge.

If the write voltage or the potential difference between the data electrodes and the scanning electrodes is increased to cause the strong discharge having a high degree of ionization, then an insufficient quantity of the wall charges is formed for prompt transition from the write discharge to the sustaining discharge. This strong write discharge is likely to be spread over the entirety of the surface electrode, whereby a large quantity of the wall charges is formed on the unnecessary area other than the edges of the surface electrode.

FIG. 7 is a schematic view of the opposite discharge or the write discharge between the data electrode and the scanning electrode shown in FIG. 2. In FIG. 7, the surface discharge or the sustaining discharge is not illustrated.

Once the large quantity of the wall charges is formed over the entirety of the surface electrode, the wall charges on the surface electrodes provide an undesirable influence to adjacent cells, thereby causing a discharge interference. This discharge interference may cause erroneous light-on and light-off. To avoid the erroneous light-on and light-off, it is necessary to narrow the operational voltage range. The unnecessary charge and discharge are increased in connection with the write discharge, resulting in an increased power consumption.

If the sustaining voltage level or a potential difference between the sustaining electrodes and the scanning electrodes is increased in place of increasing the write voltage, then undesirable discharges are likely to be caused in non-selected cells. To avoid these undesirable discharges, it is necessary to narrow the operational voltage range. The unnecessary charge and discharge are increased in connection with the write discharge, resulting in an increased power consumption.

Accordingly, it is desirable that a relatively strong write discharge is caused between the data electrode and the edge of the scanning electrode.

As described above, the conventional cell structure of FIG. 6 has the scanning electrode 3 with a reduced width in order to suppress the variation of the position of the discharge generation over the scanning electrode 3, thereby allowing the prompt transition from the opposite discharge as the write discharge into the surface discharge as the sustaining discharge. This structure also suppresses the desirable spread of the sustaining discharge. FIG. 8A is a schematic cross sectional view of the surface discharge or the sustaining discharge between the sustaining electrode and the scanning electrode shown in FIG. 6, wherein the sustaining electrode 4 has a potential of 0(V), whilst the scanning electrode 3 has a potential of Vs(V). FIG. 8B is a schematic cross sectional view of the surface discharge or the sustaining discharge between the sustaining electrode and the scanning electrode shown in FIG. 6, wherein the sustaining electrode 4 has a potential of Vs(V), whilst the scanning electrode 3 has a potential of 0(V). The wall charges are generated after generation of the sustaining discharge.

As shown in FIGS. 8A and 8B, the spread of the sustaining discharge extend to the distanced edges of the sustaining electrode 4 and the scanning electrode 3. The sustaining discharge generates an isotropically radiating ultraviolet ray, whereby the fluorescent material on the outside region of the display cell region is unnecessarily irradiated with a small part of the isotropically radiating ultraviolet ray, and the fluorescent material on the outside region emits a weak visible light of a low luminance.

It is desirable that the sustaining discharge is widely spread over the entirety of the display cell in order to obtain a possible high brightness or luminance. The spread of the sustaining discharge is excessively wide, thereby causing a discharge interference. This discharge interference may cause erroneous light-on and light-off. It is not preferable that the scanning electrodes 3 and the sustaining electrodes 4 as the surface electrodes extend unnecessary toward the boundary with the adjacent cells.

If the electrode area in the vicinity of the surface discharge gap is excessively small, then the insufficient quantity of the wall charges is formed, resulting in undesirable increase of the sustaining voltage and narrowing the available voltage range for performing the required memory function. It is preferable that the sustaining electrode is larger than the scanning electrode in the area in the vicinity of the surface discharge gap in order to make it easy to cause the sustaining discharge subsequent to the write discharge.

In order to obtain the desirable display quality, there are important respective performances of the different kinds of the electrodes, for example, the data electrodes, and the scanning electrodes as well as the sustaining electrodes. For example, the scanning electrodes are operated for both the write discharge and the sustaining discharge, whilst the sustaining electrodes are operated for only the sustaining discharge. The scanning electrodes and the sustaining electrodes are different from each other in the required function or role. It is preferable that the scanning electrodes and the sustaining electrodes are differently designed in consideration of the respective different roles. However, the conventional cell structure of the plasma display panel have the uniform structure for the scanning electrodes 3 and the sustaining electrodes 4 as shown in FIG. 2. This conventional structure makes it difficult that the electrodes exhibit optimum respective performances in the different roles.

In the above circumstances, the development of a novel plasma display panel free from the above problems is desirable.

SUMMARY OF THE INVENTION

Accordingly, it is an object of the present invention to provide a novel plasma display panel free from the above problems.

It is a further object of the present invention to provide a novel plasma display panel improved in display quality.

It is a still further object of the present invention to provide a novel plasma display panel having an improved cell structure free from the above problems.

It is yet a further object of the present invention to provide a novel plasma display panel having an improved cell structure for obtaining an improved display quality.

The present invention provides a plasma display panel comprising: a first substrate having a first inside face; a second substrate having a second inside face which confronts the first inside face of the first substrate; a plurality of data electrodes extending over the second inside face of the second substrate in a first horizontal direction; a plurality of separation walls extending over the second inside face of the second substrate in the first horizontal direction, and each of the separation walls separating adjacent two of the data electrodes; a plurality of scanning electrode alignments extending over the first inside face of the first substrate in a second horizontal direction; a plurality of sustaining electrode alignments extending over the second inside face of the second substrate in the second horizontal direction; and the scanning electrode alignments and the sustaining electrode alignments being alternately placed in the first horizontal direction, wherein each of the scanning electrode alignments further includes a plurality of scanning electrodes which are aligned with a predetermined constant gap in the second horizontal direction, and which are electrically connected to each other through a first electrode interconnection, and adjacent two of the scanning electrodes included in each of the scanning electrode alignments are separated from each other by the separation wall, wherein each of the sustaining electrode alignments further includes a plurality of sustaining electrodes which are aligned with the predetermined constant gap in the second horizontal direction, and the sustaining electrodes being electrically connected to each other through a second electrode interconnection, and adjacent two of the sustaining electrodes included in each of the scanning electrode alignments are also separated from each other by the separation wall, and wherein the plasma display panel includes a two-dimensional array of cells, and each of the cells includes a pair of the sustaining electrode and the scanning electrode, and the paired sustaining and scanning electrodes are distanced by a surface discharge gap.

The above and other objects, features and advantages of the present invention will be apparent from the following descriptions.

BRIEF DESCRIPTION OF THE DRAWINGS

Preferred embodiments according to the present invention will be described in detail with reference to the accompanying drawings.

DETAILED DESCRIPTION OF THE PREFERRED EMBODIMENTS

Figure 1:
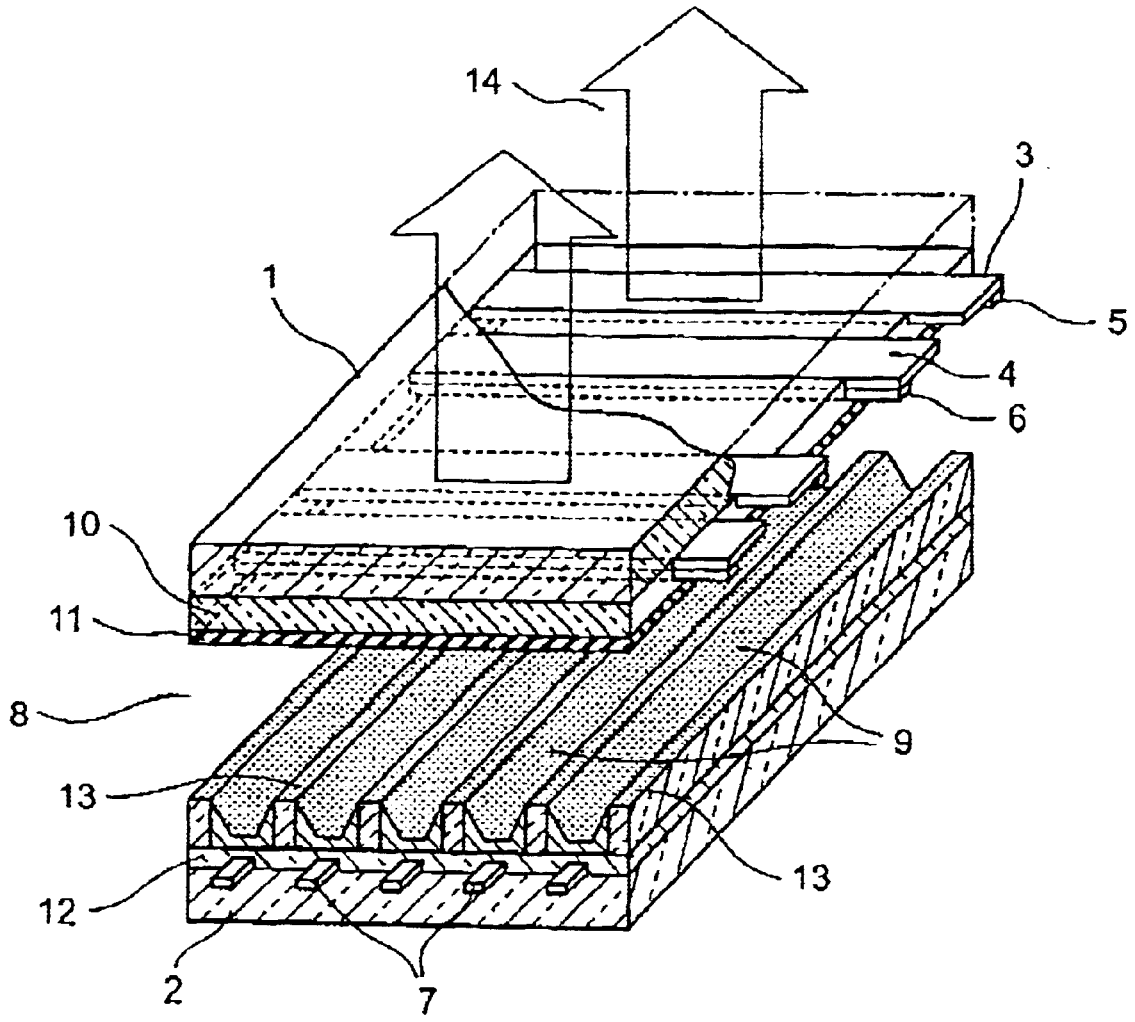
FIG. 1 prior art
FIG. 1 is a perspective view illustrative of a panel structure of a conventional alternating current surface discharge memory type plasma display panel.
Figure 2:
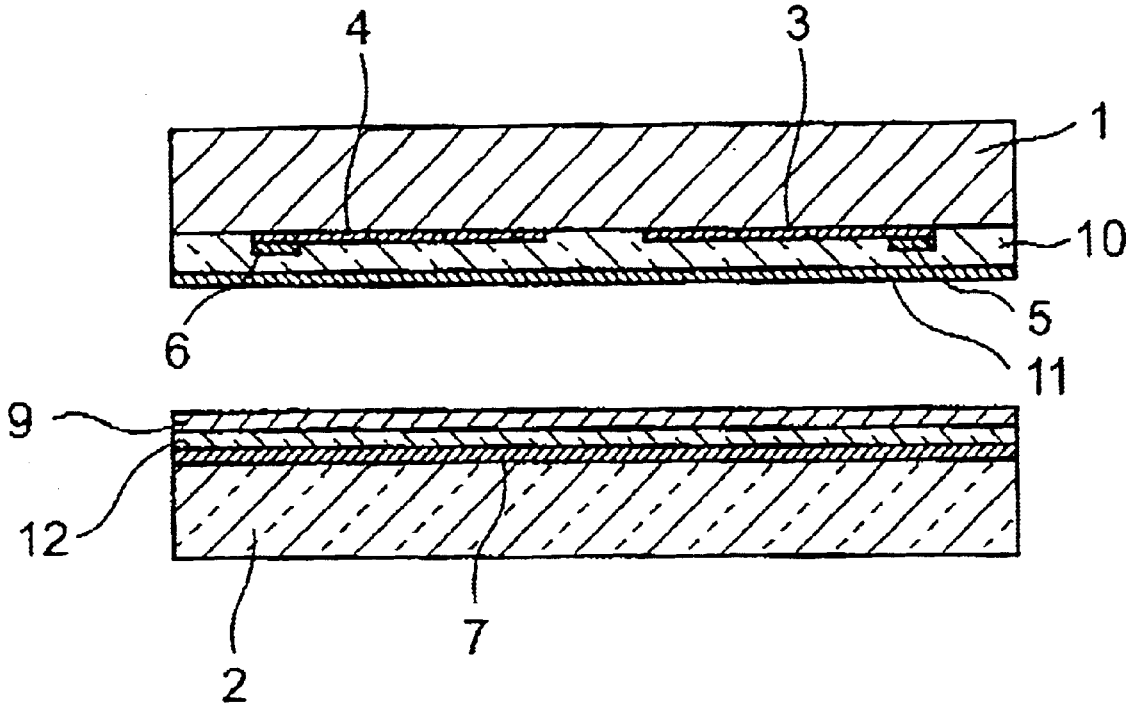
FIG. 2 prior art
FIG. 2 is a cress sectional elevation view illustrative of a display cell structure of the conventional alternating current surface discharge memory type plasma display panel of FIG. 1.
Figure 3:
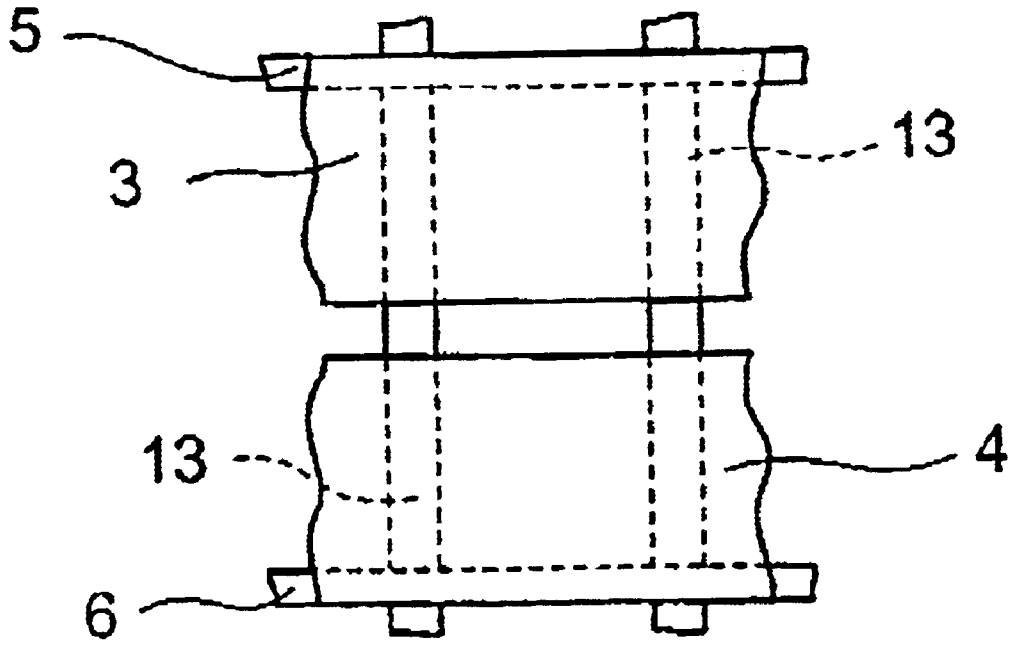
FIG. 3 prior art
FIG. 3 is a fragmentary plane view illustrative of the display cell structure of FIG. 2.
Figure 4:
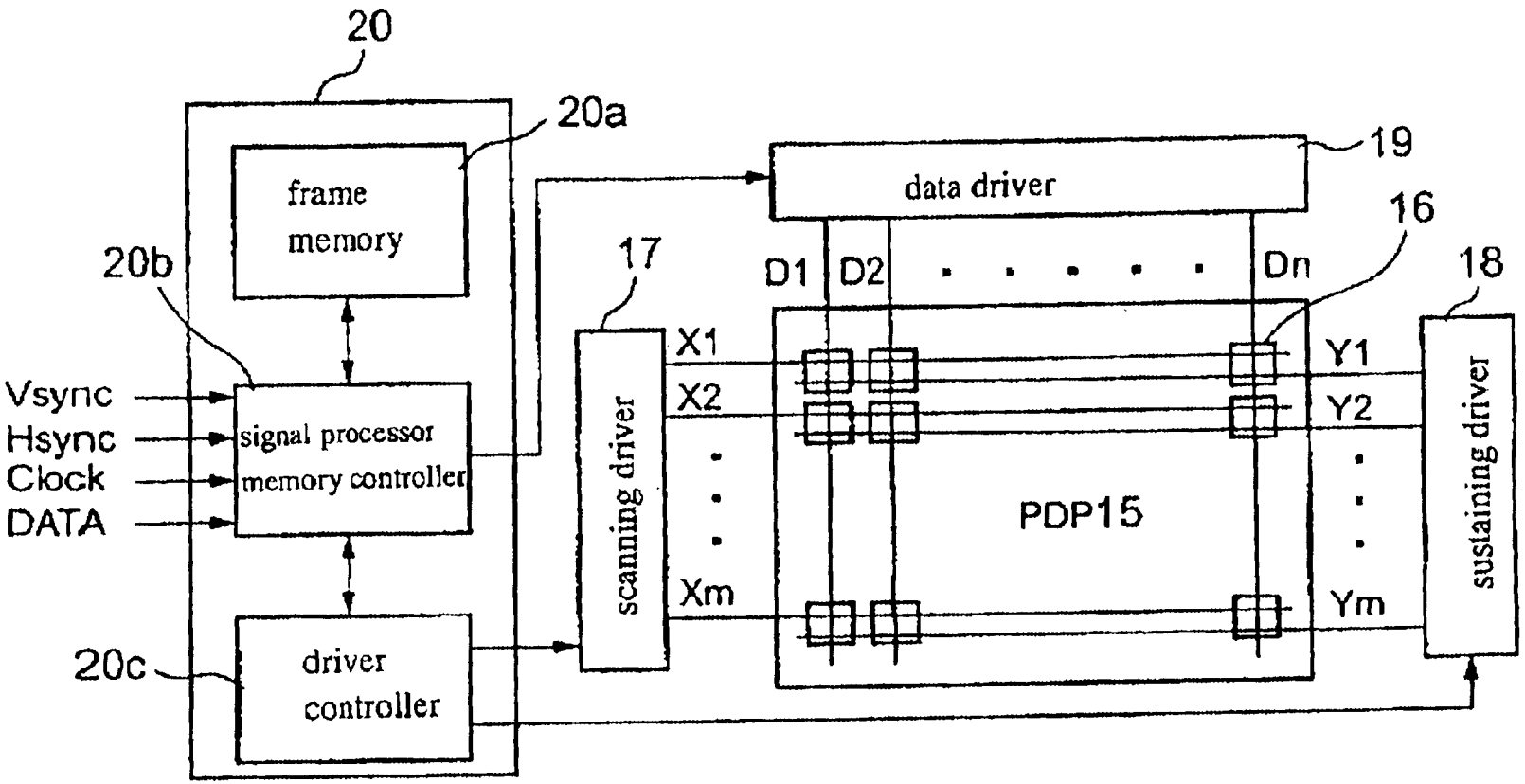
FIG. 4 prior art
FIG. 4 is a block diagram illustrative of an entire configuration of the plasma display device including the plasma display panel including a matrix array of the display cell shown in FIG. 2.
Figure 5:
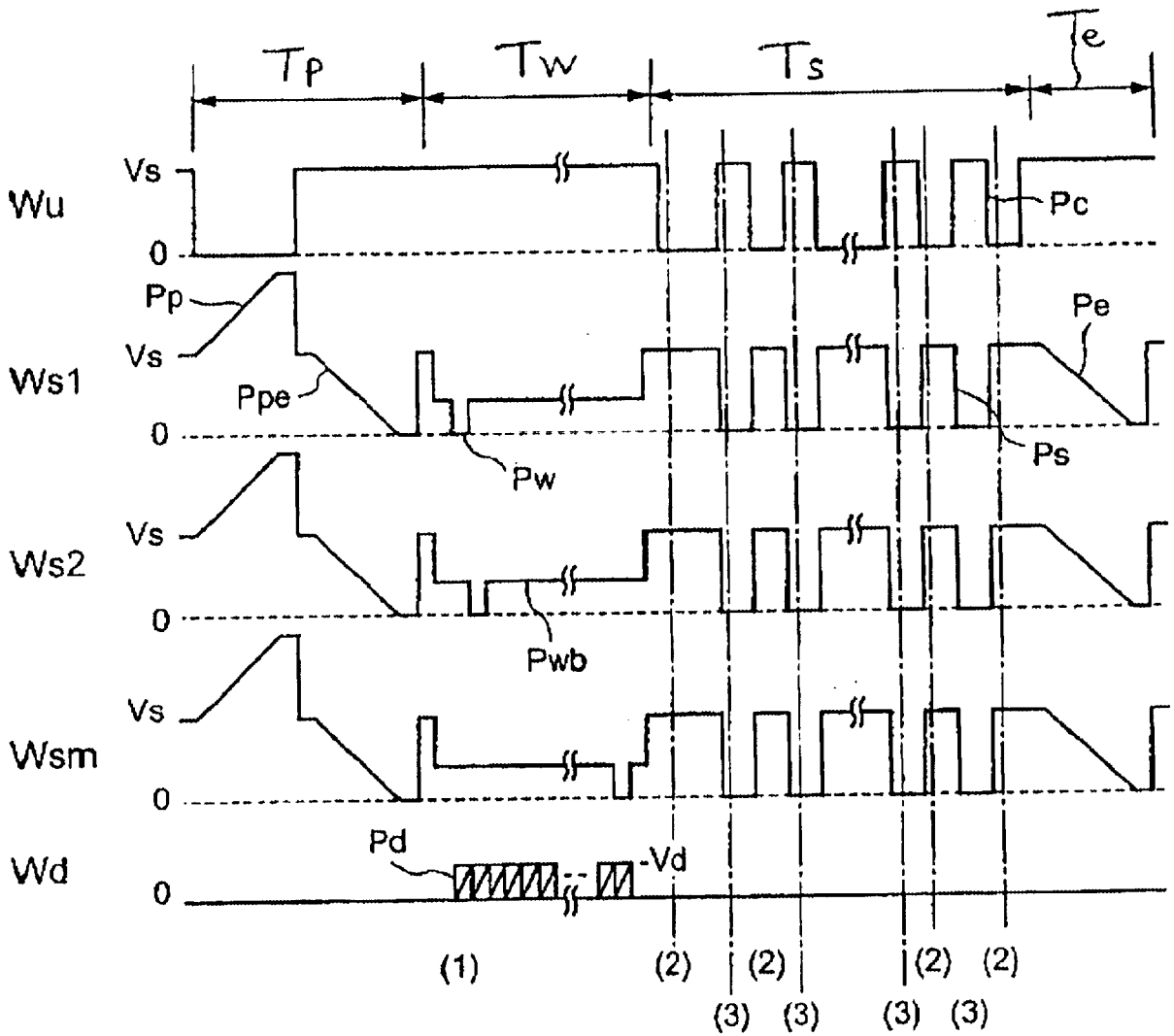
FIG. 5 prior art
FIG. 5 is a diagram illustrative of waveforms of scanning electrode driving voltage, sustaining electrode driving voltages and data electrode driving voltage in connection with the plasma display device of FIG. 4.
Figure 6:
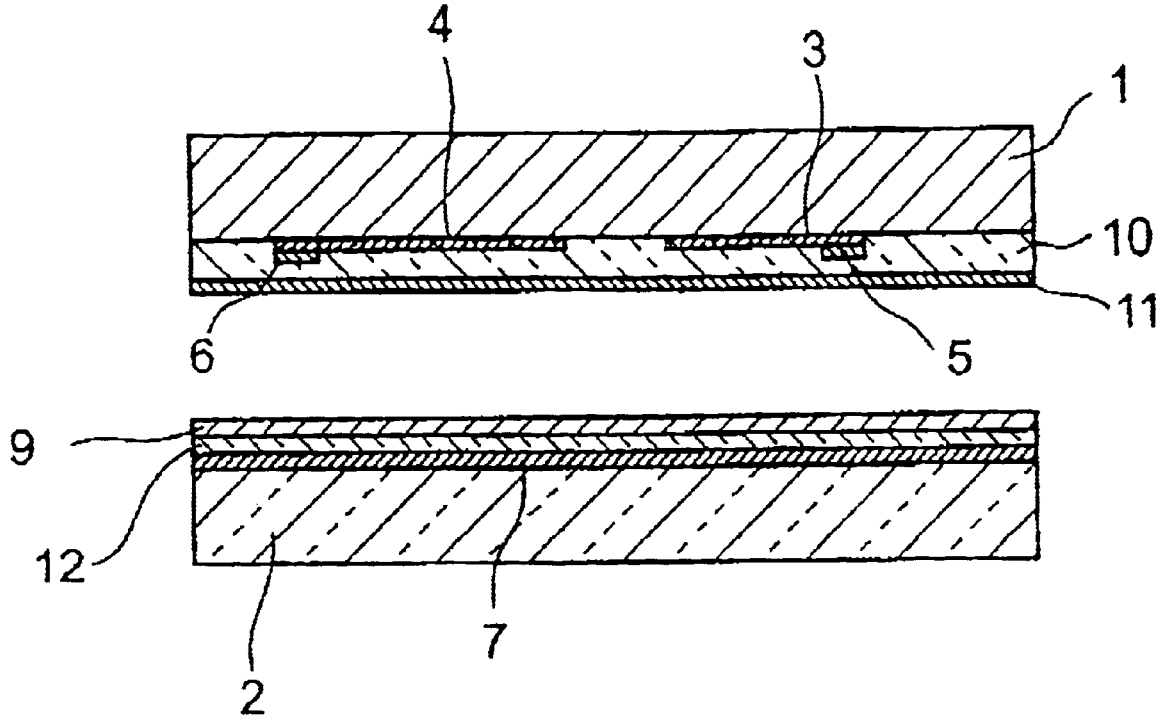
FIG. 6 prior art
FIG. 6 is a cross sectional elevation view illustrative of another conventional display cell structure of the plasma display panel.
Figure 7:
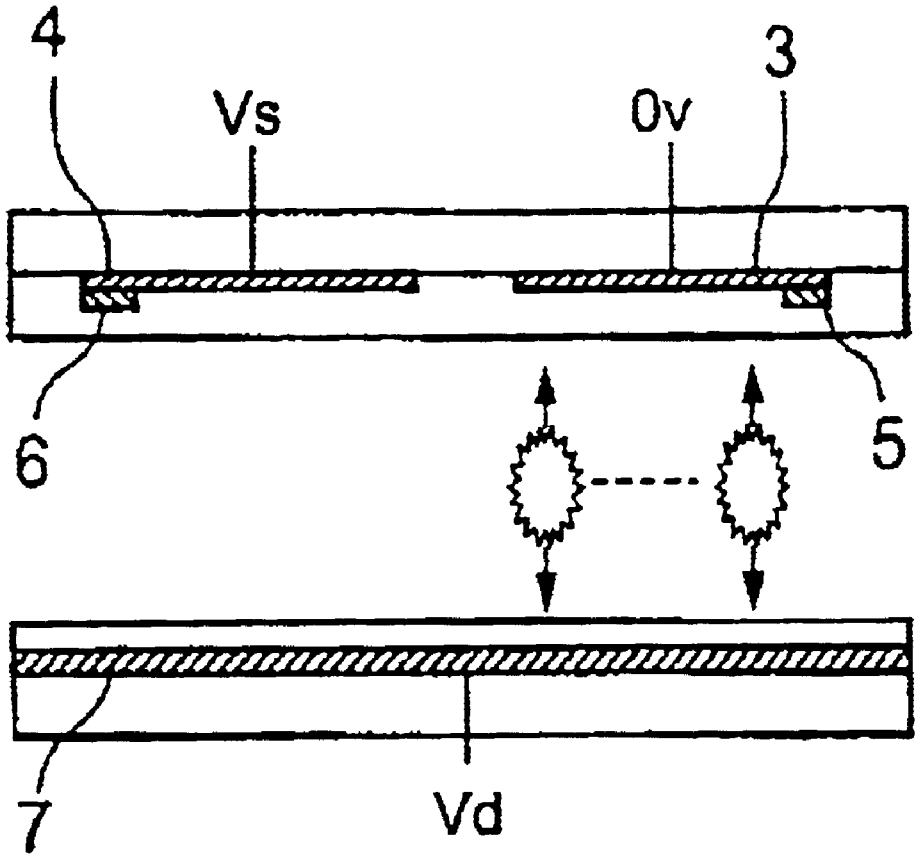
FIG. 7 prior art
FIG. 7 is a schematic cross sectional view of the opposite discharge or the write discharge between the data electrode and the scanning electrode shown in FIG. 2.
Figure 8A:
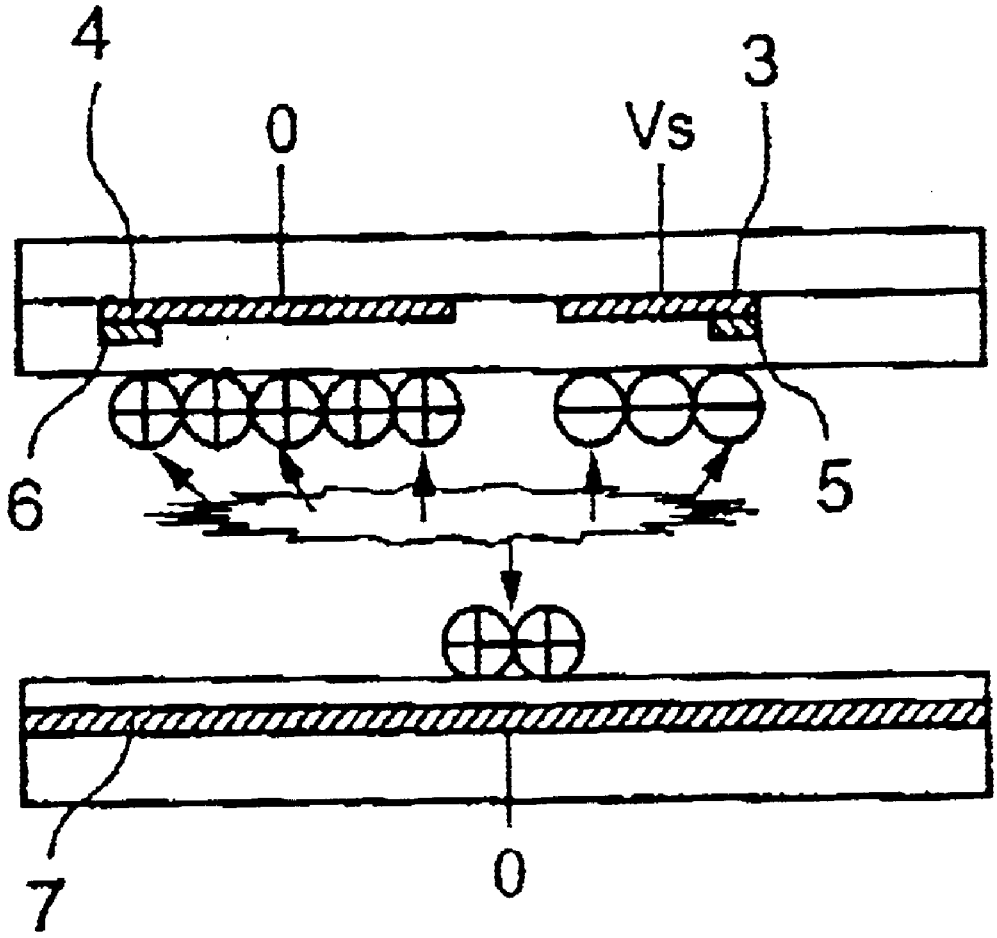
FIG. 8A prior art
FIG. 8A is a schematic cross sectional view of the surface discharge or the sustaining discharge between the sustaining electrode and the scanning electrode shown in FIG. 6, wherein the sustaining electrode 4 has a potential of 0(V), whilst the scanning electrode 3 has a potential of Vs(V).
Figure 8B:
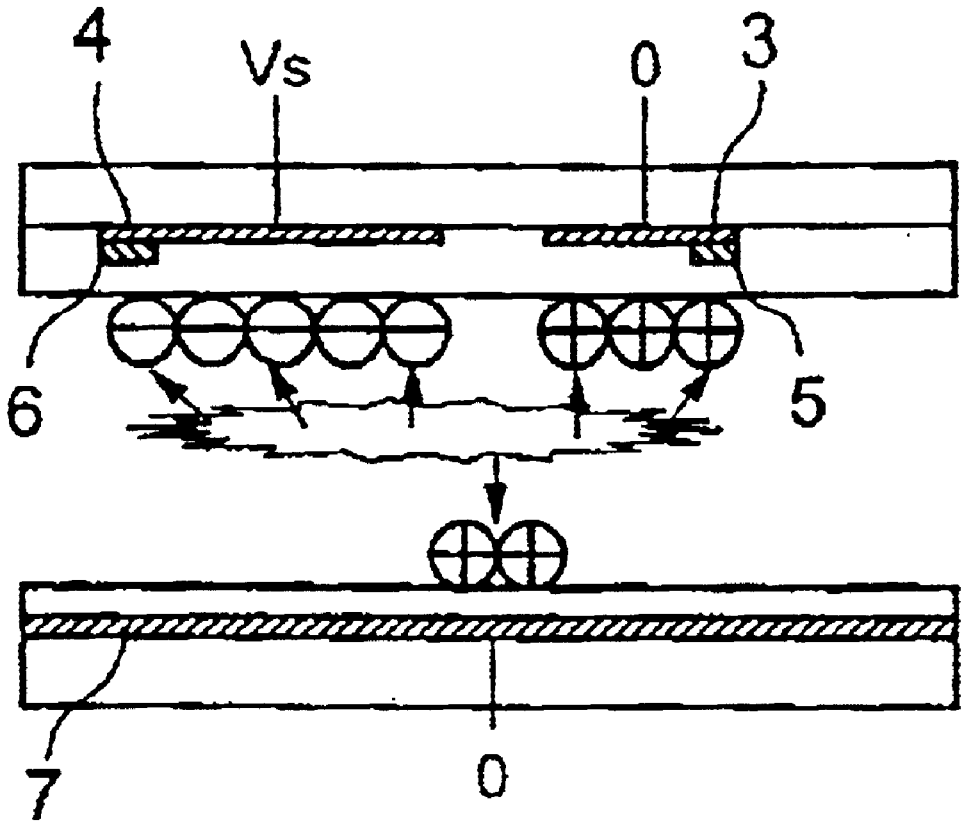
FIG. 8B prior art
FIG. 8B is a schematic cross sectional view of the surface discharge or the sustaining discharge between the sustaining electrode and the scanning electrode shown in FIG. 6, wherein the sustaining electrode 4 has a potential of Vs(V), whilst the scanning electrode 3 has a potential of 0(V).

A first aspect of the present invention is a plasma display panel comprising: a first substrate having a first inside face; a second substrate having a second inside face which confronts the first inside face of the first substrate; a plurality of data electrodes extending over the second inside face of the second substrate in a first horizontal direction; a plurality of separation walls extending over the second inside face of the second substrate in the first horizontal direction, and each of the separation walls separating adjacent two of the data electrodes; a plurality of scanning electrode alignments extending over the first inside face of the first substrate in a second horizontal direction; a plurality of sustaining electrode alignments extending over the second inside face of the second substrate in the second horizontal direction; and the scanning electrode alignments and the sustaining electrode alignments being alternately placed in the first horizontal direction, wherein each of the scanning electrode alignments further includes a plurality of scanning electrodes which are aligned with a predetermined constant gap in the second horizontal direction, and which are electrically connected to each other through a first electrode interconnection, and adjacent two of the scanning electrodes included in each of the scanning electrode alignments are separated from each other by the separation wall, wherein each of the sustaining electrode alignments further includes a plurality of sustaining electrodes which are aligned with the predetermined constant gap in the second horizontal direction, and the sustaining electrodes being electrically connected to each other through a second electrode interconnection, and adjacent two of the sustaining electrodes included in each of the scanning electrode alignments are also separated from each other by the separation wall, and wherein the plasma display panel includes a two-dimensional array of cells, and each of the cells includes a pair of the sustaining electrode and the scanning electrode, and the paired sustaining and scanning electrodes are distanced by a surface discharge gap.

It is also preferable that respective areas of the paired sustaining and scanning electrodes are approximately similar or equal to each other, whilst respective pattern shapes of the paired sustaining and scanning electrodes are different from each other.

It is also preferable that each of the sustaining electrodes comprises a first half part closer to a first side adjacent to the surface discharge gap bounding the paired sustaining and scanning electrodes, and a second half part adjacent to a second side opposite to the first side, and the first and second half parts are bounded by a boundary which is positioned at an intermediate between the first and second sides, and the first half part is larger in area than the second half part.

It is also preferable that the pattern shape of each of the sustaining electrodes is symmetrical with reference to the second horizontal direction, and asymmetrical with reference to the first horizontal direction.

It is also preferable that the pattern shape of each of the sustaining electrodes has a recess, a majority of which extends in the second half part.

It is also preferable that the pattern shape of each of the sustaining electrodes has a uniform size defined in the second horizontal direction over positions in the first horizontal direction.

It is also preferable that the pattern shape of each of the sustaining electrodes has a decrease in width defined in the second horizontal direction from the first side to the second side.

It is also preferable that each of the scanning electrodes comprises a first half part closer to a first side adjacent to the surface discharge gap bounding the paired sustaining and scanning electrodes, and a second half part adjacent to a second side opposite to the first side, and the first and second half parts are bounded by a boundary which is positioned at an intermediate between the first and second sides, and the first half part of the sustaining electrode is larger in area than the first half part of the scanning electrode.

It is also preferable that each of the sustaining electrodes comprises a first half part closer to a first side adjacent to the surface discharge gap bounding the paired sustaining and scanning electrodes, and a second half part adjacent to a second side opposite to the first side, and the first and second half parts are bounded by a boundary which is positioned at an intermediate between the first and second sides, and wherein each of the scanning electrodes comprises a first half part closer to a first side adjacent to the surface discharge gap bounding the paired sustaining and scanning electrodes, and a second half part adjacent to a second side opposite to the first side, and the first and second half parts are bounded by a boundary which is positioned at an intermediate between the first and second sides, and the first half part of the sustaining electrode is larger in area than the first half pan of the scanning electrode.

It is also preferable that each of the scanning electrodes has a pattern shape which causes a field concentration at a position closer to a first side adjacent to the surface discharge gap than a second side opposite to the first side.

It is also preferable that the pattern shape of each of the scanning electrodes has a recess which extends closer to the first side than the second side.

It is also preferable that the pattern shape of each of the scanning electrodes is a generally T-shape including a wide portion closer to the surface discharge gap.

It is also preferable that the pattern shape of each of the scanning electrodes has a plurality of recesses which are aligned in the first horizontal direction.

It is also preferable that the pattern shape of each of the scanning electrodes is a generally U-shape having a closing side adjacent to the surface discharge gap and an opening side opposite to the closing side.

It is also preferable that the pattern shape of each of the scanning electrodes comprises a center main part extending in the first horizontal direction and a plurality of subordinate parts extending from the center main part toward opposite directions parallel to the second horizontal directions.

It is also preferable that each the cells is defined by the first and second electrode interconnections and adjacent two of the separation walls.

It is also preferable that the first and second electrode interconnections comprise first and second bus electrodes respectively.

A second aspect of the present invention is a cell electrode structure of a plasma display panel, the cell surface electrode structure including: a pair of sustaining and scanning electrodes which are approximately similar or equal in area to each other, and which are different from each other in pattern shape.

It is also preferable that the paired sustaining and scanning electrodes are interposed between adjacent two of separation walls extending in a first horizontal direction, and the paired sustaining and scanning electrodes are separated from each other by a surface discharge gap in the first horizontal direction.

It is also preferable that each of the sustaining electrodes comprises a first half part closer to a first side adjacent to the surface discharge gap bounding the paired sustaining and scanning electrodes, and a second half part adjacent to a second side opposite to the first side, and the first and second half parts are bounded by a boundary which is positioned at an intermediate between the first and second sides, and the first half part is larger in area than the second half part.

It is also preferable that the pattern shape of each of the sustaining electrodes is symmetrical with reference to the second horizontal direction, and asymmetrical with reference to the first horizontal direction.

It is also preferable that the pattern shape of each of the sustaining electrodes has a recess, a majority of which extends in the second half part.

It is also preferable that the pattern shape of each of the sustaining electrodes has a uniform size defined in the second horizontal direction over positions in the first horizontal direction.

It is also preferable that the pattern shape of each of the sustaining electrodes has a decrease in width defined in the second horizontal direction from the first side to the second side.

It is also preferable that each of the scanning electrodes comprises a first half part closer to a first side adjacent to the surface discharge gap bounding the paired sustaining and scanning electrodes, and a second half part adjacent to a second side opposite to the first side, and the first and second half parts are bounded by a boundary which is positioned at an intermediate between the first and second sides, and the first half part of the sustaining electrode is larger in area than the first half part of the scanning electrode.

It is also preferable that each of the sustaining electrodes comprises a first half part closer to a first side adjacent to the surface discharge gap bounding the paired sustaining and scanning electrodes, and a second half part adjacent to a second side opposite to the first side, and the first and second half parts are bounded by a boundary which is positioned at an intermediate between the first and second sides, and wherein each of the scanning electrodes comprises a first half part closer to a first side adjacent to the surface discharge gap bounding the paired sustaining and scanning electrodes, and a second half part adjacent to a second side opposite to the first side, and the first and second half parts are bounded by a boundary which is positioned at an intermediate between the first and second sides, and the first half part of the sustaining electrode is larger in area than the first half part of the scanning electrode.

It is also preferable that each of the scanning electrodes has a pattern shape which causes a field concentration at a position closer to a first side adjacent to the surface discharge gap than a second side opposite to the first side.

It is also preferable that the pattern shape of each of the scanning electrodes has a recess which extends closer to the first side than the second side.

It is also preferable that the pattern shape of each of the scanning electrodes is a generally T-shape including a wide portion closer to the surface discharge gap.

It is also preferable that the pattern shape of each of the scanning electrodes has a plurality of recesses which are aligned in the first horizontal direction.

It is also preferable that the pattern shape of each of the scanning electrodes is a generally U-shape having a closing side adjacent to the surface discharge gap and an opening side opposite to the closing side.

It is also preferable that the pattern shape of each of the scanning electrodes comprises a center main part extending in the first horizontal direction and a plurality of subordinate parts extending from the center main part toward opposite directions parallel to the second horizontal directions.

It is also preferable that each the cells is defined by the first and second electrode interconnections and adjacent two of the separation walls.

It is also preferable that the first and second electrode interconnections comprise first and second bus electrodes respectively.

Figure 9:
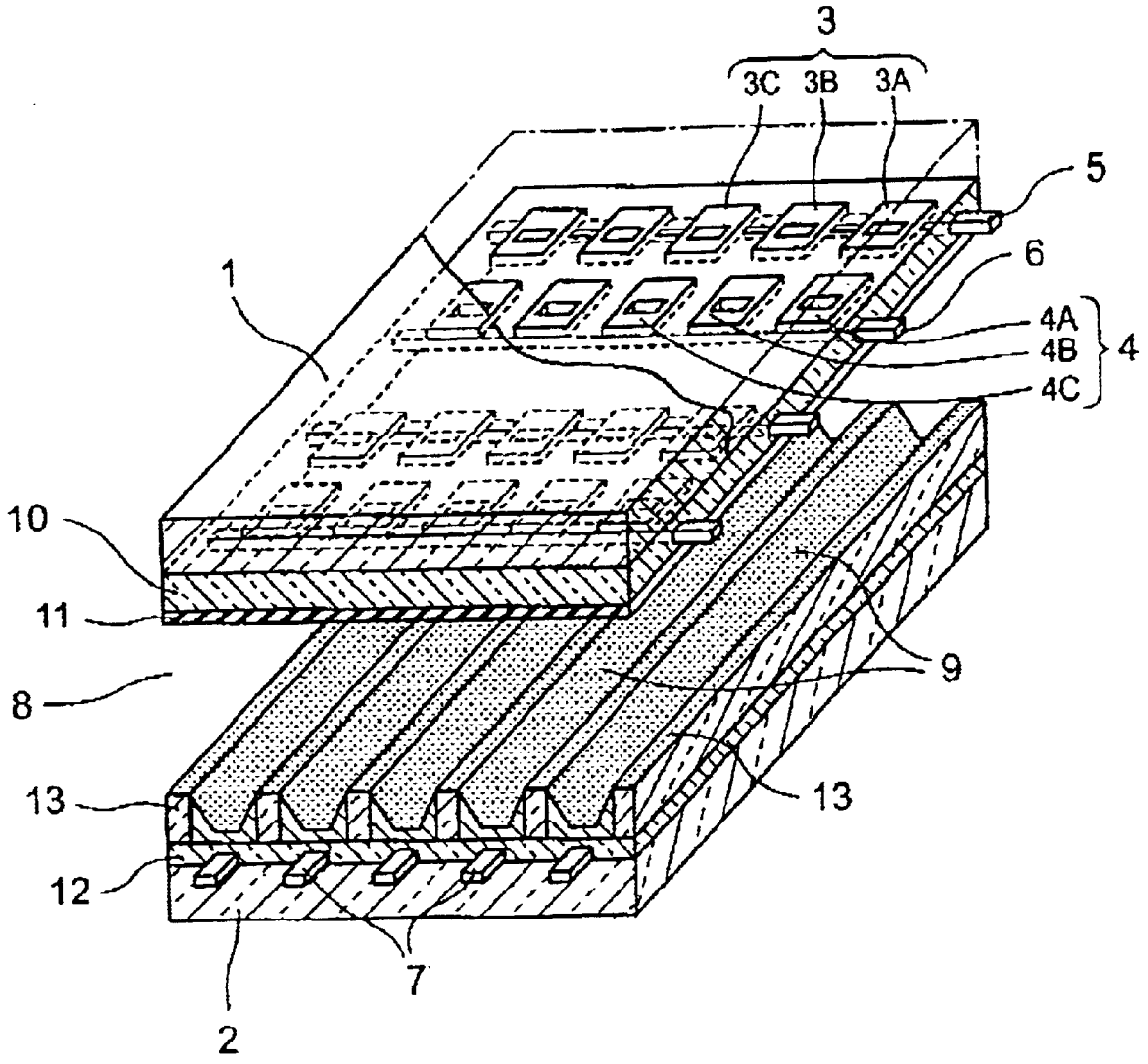
FIG. 9 is a perspective view illustrative of a panel structure of a novel plasma display panel in accordance with the present invention.

First Embodiment:

A first embodiment according to the present invention will be described in detail with reference to the drawings. FIG. 9 is a perspective view illustrative of a panel structure of a novel plasma display panel in accordance with the present invention.

The novel plasma display panel has a front side insulative substrate 1 and a back side insulative substrate 2. A plurality of scanning electrode alignments 3 and a plurality of sustaining electrode alignments 4 are provided on an inside face of the front side insulative substrate 1. The scanning electrode alignments 3 and the sustaining electrode alignments 4 are alternately placed at a predetermined pitch in a first horizontal direction. The scanning electrode alignments 3 and the sustaining electrode alignments 4 extend in parallel to each other and in a second horizontal direction which is perpendicular to the first horizontal direction.

Each of the scanning electrode alignments 3 further comprises scanning electrodes 3A, 3B, 3C, . . . aligned at a constant pitch in the second horizontal direction. Each of the scanning electrodes 3A, 3B, 3C, . . . has a rectangle shaped periphery.

Each of the sustaining electrode alignments 4 further comprises sustaining electrodes 4A, 4B, 4C, . . . aligned in the second horizontal direction at the same constant pitch as the scanning electrodes 3A, 3B, 3C, . . . so as to make a plurality of pairs of the scanning electrodes 3A, 3B, 3C, . . . and the sustaining electrodes 4A, 4B, 4C, . . . . Each of the sustaining electrode alignments 4 have the same number of the sustaining electrodes 4A, 4B, 4C, . . . as the scanning electrodes 3A, 3B, 3C, . . . included in corresponding one of the scanning electrode alignments 3.

Each display cell corresponds to each luminescent pixel. Each display cell includes a single pair of the scanning electrode alignments 3 and the sustaining electrode alignments 4. For example, a display cell includes a single pair of the scanning electrode 3A and the sustaining electrode 4A. Another display cell includes still another single pair of the scanning electrode 3C and the sustaining electrode 4C. The paired scanning and sustaining electrode alignments 3 and 4 are distanced by a predetermined surface discharge gap. The gap is uniform for all pairs of the scanning electrodes 3A, 3B, 3C, . . . and the sustaining electrodes 4A, 4B, 4C, . . . .

A plurality of first bus electrodes 5 are provided for the plural scanning electrode alignments 3. Each of the first bus electrodes 5 is provided for each of the plural scanning electrode alignments 3. The scanning electrodes 3A, 3B, 3C, . . . included in each of the plural scanning electrode alignments 3 are electrically connected with the corresponding one of the first bus electrodes 5. Namely, all of the scanning electrodes 3A, 3B, 3C, . . . included in each of the plural scanning electrode alignments 3 are electrically connected to each other through the first bus electrode 5.

Each of the first bus electrodes 5 also has a stripe shape and extend in the second direction. The first bus electrodes 5 have a smaller width than the scanning electrodes 3A, 3B, 3C, . . . . Each of the first bus electrodes 5 is aligned to an opposite side of each of the scanning electrode alignments 3 to a side adjacent to the surface discharge gap which separates the paired scanning and sustaining electrode alignments 3 and 4.

A plurality of second bus electrodes 6 are provided for the plural sustaining electrode alignments 4. Each of the second bus electrodes 6 is provided for each of the plural sustaining electrode alignments 4. The sustaining electrodes 4A, 4B, 4C, . . . included in each of the plural sustaining electrode alignments 4 are electrically connected with the corresponding one of the second bus electrodes 6. Namely, all of the sustaining electrodes 4A, 4B, 4C, . . . included in each of the plural sustaining electrode alignments 4 are electrically connected to each other through the second bus electrode 6.

Each of the second bus electrodes 6 also has a stripe shape and extend in the second direction. The second bus electrodes 6 have a smaller width than the sustaining electrodes 4A, 4B, 4C, . . . . Each of the second bus electrodes 6 is aligned to an opposite side of each of the sustaining electrodes 4 to a side adjacent to the surface discharge gap which separates the paired scanning and sustaining electrodes 3 and 4.

A plurality of data electrodes 7 are provided on an inside face of the back side insulative substrate 2. The data electrodes 7 are aligned in the second horizontal direction at the predetermined constant pitch which is equal to the pitch of the scanning electrodes 3A, 3B, 3C, . . . and the sustaining electrodes 4A, 4B, 4C, . . . . The data electrodes 7 have a stripe shape. The data electrodes 7 extend in parallel to each other and in the first horizontal direction which is perpendicular to the second horizontal direction along which the scanning electrode alignments 3 and the sustaining electrode alignments 4 extend. Namely, each of the data electrodes 7 extends across the plural scanning electrode alignments 3 and the plural sustaining electrode alignments 4.

A discharge gas is filled within an inter-space 8 defined between the front side insulative substrate 1 and the back side insulative substrate 2. The discharge gas may be a helium gas, a neon gas, a xenon gas or a mixture gas thereof.

A first dielectric layer 10 is provided on the inside face of the front side insulative substrate 1, so that the scanning electrode alignments 3, the sustaining electrode alignments 4, the first bus electrodes 5 and the second bus electrodes 6 are buried in the first dielectric layer 10. A protection layer 11 is provided on an inside face of the first dielectric layer 10 for protecting the dielectric layer 10 from the discharge. The protection layer 11 may optically comprise magnesium oxide.

A second dielectric layer 12 is provided on the inside face of the back side insulative substrate 2, so that the data electrodes 7 are buried in the first dielectric layer 10.

A plurality of separation walls 13 are provided on an inside face of the second dielectric layer 12. The separation walls 13 extend in straight in parallel to each other and in the first horizontal direction, so that the separation walls 13 extend in parallel to the data electrodes 7. In the plane view vertical to the surface of the back side insulative substrate 2, each of the separation walls 13 is positioned between adjacent two of the data electrodes 7, so that each of the data electrodes 7 is positioned under each gap defined between adjacent two of the separation walls 13. The separation walls 13 define plural display cell regions, wherein each of the separation walls 13 separates adjacent two of the plural display cell regions.

In the plane view vertical to the surface of the back side insulative substrate 2, each of the separation walls 13 extends across the plural scanning electrode alignments 3 and the plural sustaining electrode alignments 4, wherein each of the separation walls 13 extends between adjacent two of the scanning electrodes 3A, 3B, 3C, . . . included in each of the plural scanning electrode alignments 3 and also between adjacent two of the sustaining electrodes 4A, 4B, 4C, . . . . Namely, the adjacent two of the scanning electrodes 3A, 3B, 3C, . . . included in each of the plural scanning electrode alignments 3 are positioned in opposite sides of the separation wall in the plane view vertical to the surface of the back side insulative substrate 2. The adjacent two of the sustaining electrodes 4A, 4B, 4C, . . . included in each of the plural sustaining electrode alignments 4 are also positioned in opposite sides of the separation wall in the plane view vertical to the surface of the back side insulative substrate 2.

A fluorescent material 9 is applied on exposed regions of the inner face of the second dielectric layer 12 and side walls of the separation walls 13, wherein the exposed regions of the inner face of the second dielectric layer 12 are exposed to the plural display cell regions defined by the separation walls 13. The fluorescent material 9 includes two dimensional arrays of three primary colors. The discharge gas generates the ultraviolet ray which is then irradiated onto the fluorescent material 9, whereby the fluorescent material 9 shows the luminescence in accordance with the three primary colors, and a visible light 14 is emitted from an outside surface of the front side insulative substrate 1.

Figure 10:
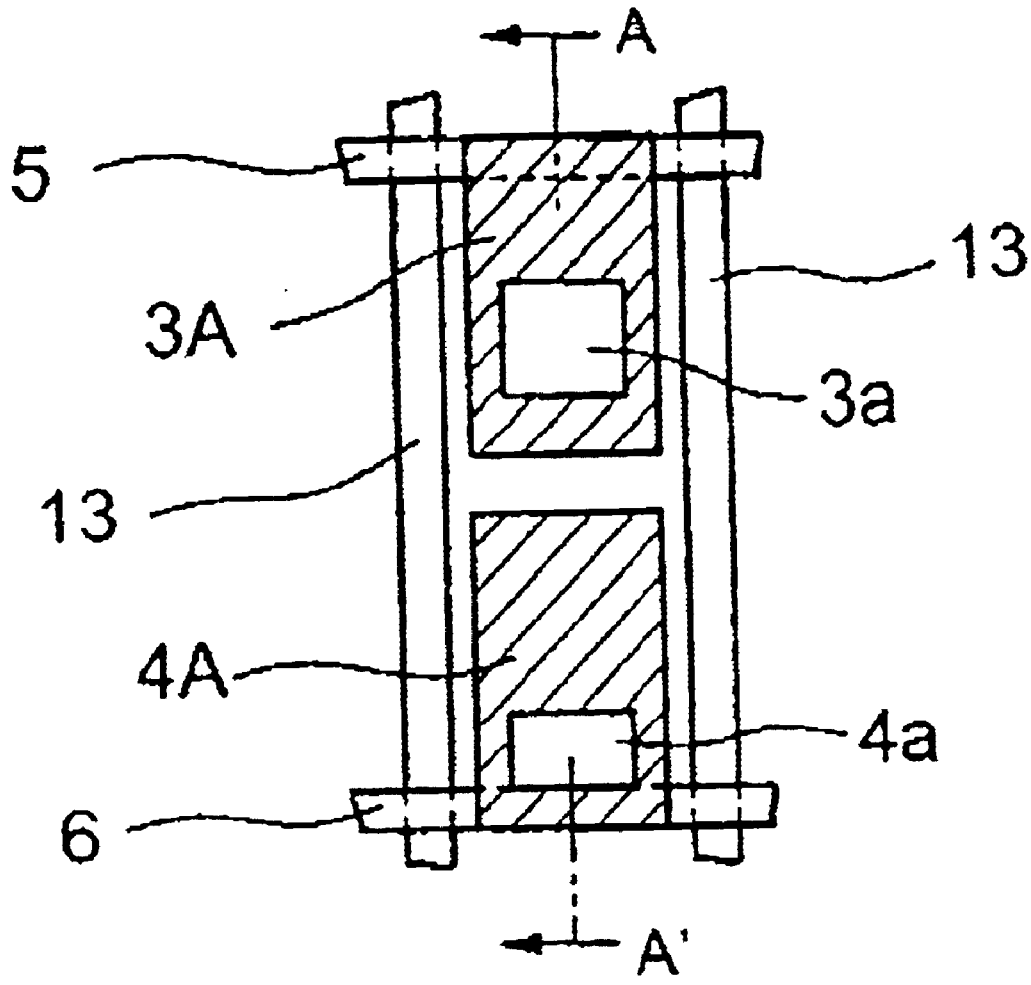
FIG. 10 is a fragmentary plane view illustrative of examples of the respective shapes of the paired scanning and sustaining electrodes in each display cell.

FIG. 10 is a fragmentary plane view illustrative of the respective shapes of the paired scanning and sustaining electrodes in each display cell. In the plane view vertical to the surface of the back side insulative substrate 2, the paired scanning and sustaining electrodes 3A and 4A are positioned in a rectangle-shaped cell region which is defined by the adjacent first and second bus electrodes 5 and 6 and also by adjacent two of the separation walls 13. The paired scanning and sustaining electrodes 3A and 4A are distanced from each other by the surface discharge gap.

The scanning electrode 3A has a rectangle-shaped periphery having a longitudinal axis in parallel to the separation walls 13 and in the first horizontal direction. The scanning electrode 3A has a first short side adjacent to the surface discharge gap. The scanning electrode 3A has an opposite side to the first short side adjacent to the surface discharge gap. The opposite side of the scanning electrode 3A is aligned to the first bus electrode 5. The scanning electrode 3A has a single recess 3*a* which is generally square-shaped, wherein the single recess 3*a* is positioned on a longitudinal center line of the scanning electrode 3A but positioned closer to the first short side adjacent to the surface discharge gap than the opposite side.

The sustaining electrode 4A also has a rectangle-shaped periphery having a longitudinal axis in parallel to the separation walls 13 and in the first horizontal direction. The sustaining electrode 4A has a first short side adjacent to the surface discharge gap. The first short side of the sustaining electrode 4A is distanced by the surface discharge gap from the first short side of the scanning electrode 3A. The sustaining electrode 4A has an opposite side to the first short side adjacent to the surface discharge gap. The opposite side of the sustaining electrode 4A is aligned to the second bus electrode 6. The sustaining electrode 4A has a single recess 4*a* which is generally rectangle-shaped, wherein the single recess 4*a* is positioned on a longitudinal center line of the sustaining electrode 4A but positioned closer to the opposite side than the first short side adjacent to the surface discharge gap.

The paired scanning and sustaining electrodes 3A and 4A have the same width which is defined by a size defined in the second horizontal direction along the first and second bus electrodes 5 and 6. The paired scanning and sustaining electrodes 3A and 4A have the same length which is defined by another size defined in the first horizontal direction along the separation walls 13. Respective areas of the paired scanning and sustaining electrodes 3A and 4A are approximately similar to each other, whilst the paired scanning and sustaining electrodes 3A and 4A are different in pattern shape from each other as clearly apparently from FIG. 10.

Figure 11A:
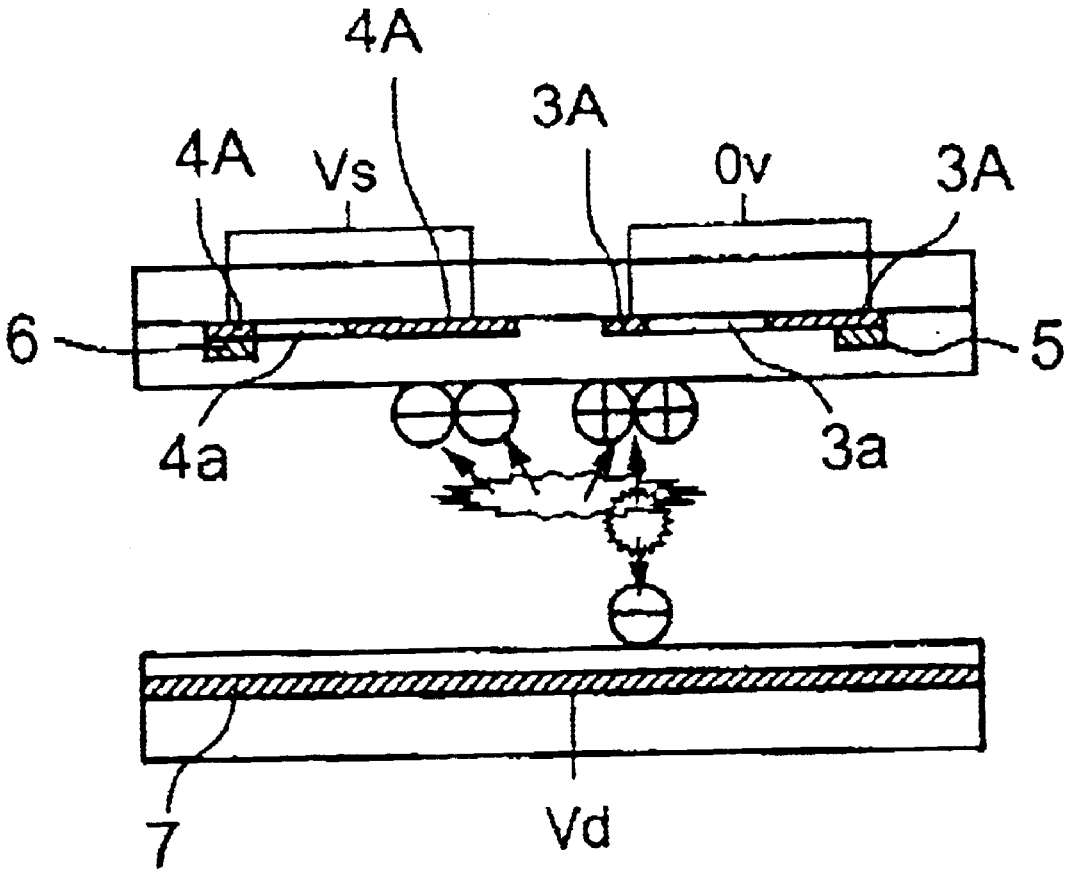
FIG. 11A is a cross sectional elevation view illustrative of the wall charges in connection with a write discharge and a sustaining discharge in the cell, taken along an A–A' line of FIG. 10.
Figure 11B:
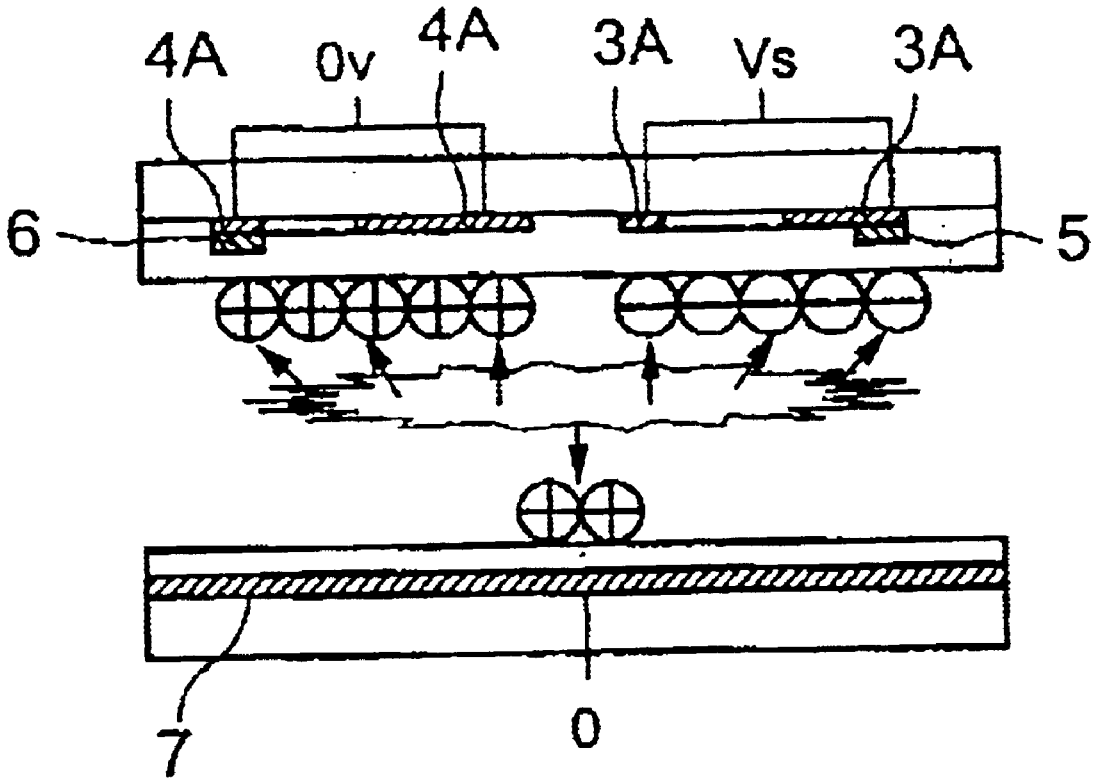
FIG. 11B is a cross sectional elevation view illustrative of the wall charges in connection with a sustaining discharge in the cell, taken along an A–A' line of FIG. 10.
Figure 11C:
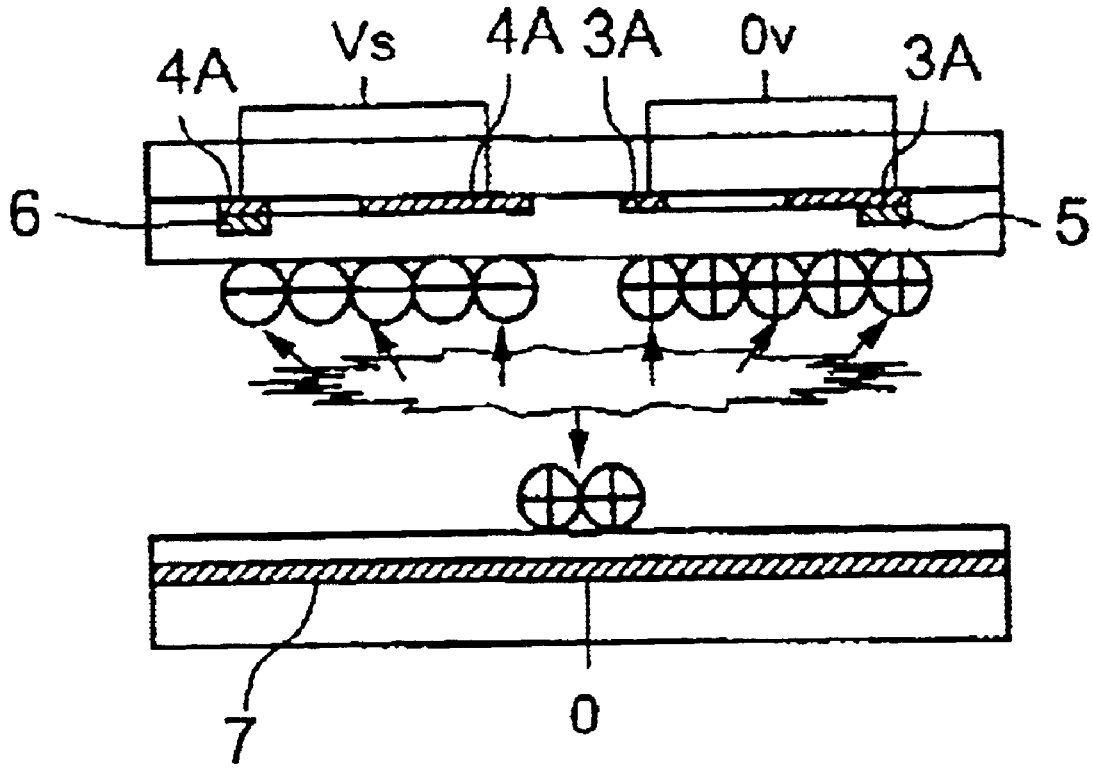
FIG. 11C is a cross sectional elevation view illustrative of the wall charges in connection with another sustaining discharge in the cell, taken along an A–A' line of FIG. 10.

FIG. 11A is a cross sectional elevation view illustrative of the wall charges in connection with a write discharge and a sustaining discharge in the cell, taken along an A–A' line of FIG. 10. FIG. 11B is a cross sectional elevation view illustrative of the wall charges in connection with a sustaining discharge in the cell, taken along an A–A' line of FIG. 10. FIG. 11C is a cross sectional elevation view illustrative of the wall charges in connection with another sustaining discharge in the cell, taken along an A–A' line of FIG. 10.

In FIG. 11A, the scanning pulse is applied to the scanning electrode 3A, so that a potential of the scanning electrode 3A becomes 0(V). The data pulse is applied to the data electrode 7, so that a potential of the data electrode 7 becomes Vd(V). A potential difference between the scanning electrode 3A and the data electrode 7 becomes beyond a threshold level, thereby causing an opposite discharge as a write discharge between the scanning electrode 3A and the data electrode 7. A potential of the sustaining electrode 4A is kept at a sustaining voltage level of Vs(V), whereby a surface discharge as a sustaining discharge between the sustaining electrode 4A and the scanning electrode 3A is also caused by the opposite discharge as the write discharge. Positive charges are accumulated closer to the scanning electrode 3A. Negative charges are accumulated closer to the sustaining electrode 4A and the data electrode 7.

Since an overlapping area between the scanning electrode 3A and the data electrode 7 is small, then an opposite discharge current or a write discharge current is small. Since the scanning electrode 3A has the recess 3*a* positioned closer to the first side adjacent to the surface discharge gap or to the sustaining electrode 4A, the recess 3*a* reduces an area of a closer part of the scanning electrode 3A to the surface discharge gap or to the sustaining electrode 4A. The reduction in the area of the closer part of the scanning electrode 3A to the surface discharge gap or to the sustaining electrode 4A causes an electric field concentration in the closer part to the surface discharge gap or to the sustaining electrode 4A, whereby the opposite discharge as the write discharge is likely to be caused between the data electrode 7 and the closer part of the scanning electrode 3A to the surface discharge gap or to the sustaining electrode 4A.

As the opposite discharge or the write discharge becomes close to the surface discharge gap bounding the scanning electrode 3A and the sustaining electrode 4A, this makes it easy to cause the surface discharge as the sustaining discharge between the scanning electrode 3A and the sustaining electrode 4A because a high density region of activated particles such as space charges generated by the opposite discharge is close to the surface discharge region.

As shown in FIG. 11B, the opposite discharge as the write discharge makes a transition into the surface discharge as the sustaining discharge. The potential of the data electrode 7 is dropped to 0(V). The potential of the scanning electrode 3A is risen up to Vs(V). The potential of the sustaining electrode 4A is dropped to 0(V). A primary electric field is generated in the discharge cell space by a potential difference between the sustaining electrode 4A and the scanning electrode 3A. A secondary electric field is also generated in the discharge cell space by the positive and negative charges. The primary electric field and the secondary electric field are superimposed with each other, and the superimposed electric field is then effectively applied to the discharge cell space, wherein the superimposed electric field is beyond the threshold level, whereby the surface discharge or the sustaining discharge is caused.

The continuation of the surface discharge or the sustaining discharge causes an accumulation of the negative charges close to the scanning electrode 3A and another accumulation of the positive charges close to the sustaining electrode 4A and the data electrode 7. Those respective accumulations of the negative and positive charges cause a canceling electric field which cancels the superimposed electric field. In due time, the surface discharge or the sustaining discharge is discontinued.

As shown in FIG. 11C, subsequently, the potential of the scanning electrode 3A is dropped to 0(V), whilst the potential of the sustaining electrode 4A is risen up to Vs(V). A primary electric field is generated in the discharge cell space by a potential difference between the sustaining electrode 4A and the scanning electrode 3A. A secondary electric field is also generated in the discharge cell space by the positive and negative charges. The primary electric field and the secondary electric field are superimposed with each other, and the other superimposed electric field is again effectively applied to the discharge cell space, wherein the other superimposed electric field is beyond the threshold level, whereby the surface discharge or the sustaining discharge is again caused.

The continuation of the surface discharge or the sustaining discharge causes an accumulation of the positive charges close to the scanning electrode 3A and the data electrode 7 and another accumulation of the negative charges close to the sustaining electrode 4A. Those respective accumulations of the negative and positive charges cause another canceling electric field which cancels the other superimposed electric field. In due time, the surface discharge or the sustaining discharge is discontinued.

As well illustrated in FIGS. 11B and 11C, the spread of the sustaining discharge or the surface discharge extends between the first and second bus electrodes 5 and 6 or between the opposite side to the first side of the scanning electrode 3A and the opposite side to the first side of the sustaining electrode 4A.

The sustaining electrode 4A has the recess 4*a* which is positioned closer to the opposite side to the first side adjacent to the surface discharge gap bounding between the sustaining electrode 4A and the scanning electrode 3A. The sustaining electrode 4A has a first half region closer to the first side adjacent to the surface discharge gap and a second half region closer to the opposite side to the first side, wherein the first and second half regions are bounded by an intermediate line between the first side and the opposite side. The pattern shape of the sustaining electrode 4 is such that the first half region is larger in area than the second half region. The recess 4*a* narrows a current path on the second half region to the second bus electrode 6. The sustaining discharge is likely to extend over the first half region and unlikely to extend over the second half region. This pattern shape of the sustaining electrode 4 promotes the transition from the opposite discharge as the write discharge into the surface discharge as the sustaining discharge. This pattern shape of the sustaining electrode 4 prevents the discharge interference between adjacent cells, thereby preventing any erroneous light-on and light-off because the unnecessary accumulations of the positive and negative charges on the unnecessary regions are prevented and also the capacitive coupling between the adjacent electrodes is also reduced.

The luminance or brightness of the visible light from the fluorescent material depends on the discharge intensity and the spread of the discharge. As the discharge intensity and the spread of the discharge are large, then the luminance or brightness of the visible light is high.

The above novel structure allows a wider operational range and improves the display quality.

As described above, the scanning electrode 3A has the recess 3*a,* and also the sustaining electrode 4A has the recess 4*a*. The recess 3*a* reduces the overlapping area between the scanning electrode 3A and the data electrode 7. The recess 4*a* also reduces the overlapping area between the sustaining electrode 4A and the data electrode 7. This structure reduces a driving load and also improves the operational reliability of the plasma display panel.

As described above, the scanning electrode 3A and the sustaining electrode 4A are different from each other in pattern shape and are approximately similar in area to each other. The discharge current flowing through the electrode is generally proportional to the area of the electrode. The scanning electrode 3A and the sustaining electrode 4A are approximately similar to each other in discharge current, thereby making the discharge current stable and free of any substantive difference in the discharge current between the scanning electrode 3A and the sustaining electrode 4A. The luminance or the brightness is generally proportional to the discharge current. The scanning electrode 3A and the sustaining electrode 4A are approximately similar to each other in the luminance or the brightness. This allows the plasma display panel to have the desirable high display characteristics.

In accordance with the present invention, the paired scanning and sustaining electrodes in each cell are different from each other in pattern shape and are approximately similar or equal in area to each other. The sustaining electrode has the first half part closer to the first side adjacent to the surface discharge gap and the second half part closer to the opposite side to the first side, wherein the first half part is larger in area than the second half part, so that the surface discharge as the sustaining discharge is more likely to extend over the first half part than the second half part. The scanning electrode has the pattern shape which causes the field concentration at the position closer to the first side adjacent to the surface discharge gap than the opposite side to the first side, so that the opposite discharge as the write discharge is likely to be caused between the data electrode and the position closer to the first side of the scanning electrode and promoting the desirable prompt transition from the opposite discharge as the write discharge into the surface discharge or the sustaining discharge.

Namely, the unnecessary region of the scanning electrode is recessed to optimize the pattern shape in view of the functions of the scanning electrode for both the opposite discharge as the write discharge and also the surface discharge as the sustaining discharge. Also, the unnecessary region of the sustaining electrode is recessed to optimize the pattern shape in view of the function of the sustaining electrode for the surface discharge as the sustaining discharge. This results in a certain reduction in the discharge current without decrease of the luminance or brightness. The reductions in the respective areas of the scanning electrode and the sustaining electrode results in a reduction in the quantity of the absorption of the visible light as emitted from the fluorescent material, thereby increasing the luminance or the brightness.

As a result, the above novel structure improves the luminescent efficiency. The improved luminescent efficiency allows a bright image display with a small power and also reduces the power consumption. The reduction of the power consumption makes it easy to suppress generation of Joule heat and suppress the temperature increase of the plasma display panel, resulting in an improvement in the operational reliability of the plasma display panel.

The scanning electrode has the pattern shape which causes the field concentration at the position closer to the first side adjacent to the surface discharge gap than the opposite side to the first side, so that the opposite discharge as the write discharge is likely to be caused between the data electrode and the position closer to the first side of the scanning electrode, thereby promoting the desirable prompt transition from the opposite discharge as the write discharge into the surface discharge or the sustaining discharge.

This pattern shape of the sustaining electrode prevents the discharge interference between adjacent cells, thereby preventing any erroneous light-on and light-off because the unnecessary accumulations of the positive and negative charges on the unnecessary regions are prevented and also the capacitive coupling between the adjacent electrodes is also reduced.

The above novel structure allows a wider operational range and improves the display quality.

As described above, the scanning electrode and the sustaining electrode are different from each other in pattern shape and are approximately similar in area to each other. The discharge current flowing through the electrode is generally proportional to the area of the electrode. The scanning electrode and the sustaining electrode are approximately similar or equal to each other in discharge current, thereby making the discharge current stable and free of any substantive difference in the discharge current between the scanning electrode and the sustaining electrode. The luminance or the brightness is generally proportional to the discharge current. The scanning electrode and the sustaining electrode are approximately similar to each other in the luminance or the brightness. This allows the plasma display panel to have the desirable high display characteristics. The discharge current flowing through the electrode is generally proportional to the area of the electrode. The scanning electrode and the sustaining electrode are approximately similar or equal to each other in discharge current, thereby making the discharge current stable and free of any substantive difference in the discharge current between the scanning electrode and the sustaining electrode. The luminance or the brightness is generally proportional to the discharge current. The scanning electrode and the sustaining electrode are approximately similar to each other in the luminance or the brightness. This allows the plasma display panel to have the desirable high display characteristics.

The respective pattern shapes of the scanning electrodes and the sustaining electrodes shown in FIG. 10 are more examples available. It is, of course, possible to modify the respective pattern shapes of the scanning electrodes and the sustaining electrodes, provided that the above described conditions of the pattern shapes are satisfied.

In the above descriptions, the opposite side of the scanning electrode is aligned to the first bus electrode and also the opposite side of the sustaining electrode is aligned to the second bus electrode. Notwithstanding, it is, of course, possible to modify the relative position between the scanning electrode and the first bus electrode, provided that the scanning electrodes included in each of the scanning electrode alignments are electrically connected through the first bus electrode to each other. Similarly, it is, of course, possible to modify the relative position between the sustaining electrode and the second bus electrode, provided that the sustaining electrodes included in each of the sustaining electrode alignments are electrically connected through the second bus electrode to each other.

The preliminary discharges such as a reset discharge for erasing excess wall charges and a priming discharge for promoting the caution of the discharge is likely to be confined or concentrated at a closer position to the surface discharge gap. This allows that a black-brightness in the black-display is well suppressed to increase the display contrast ratio of a white-brightness to the black-brightness, resulting in an improvement of the display quality.

Figure 12:
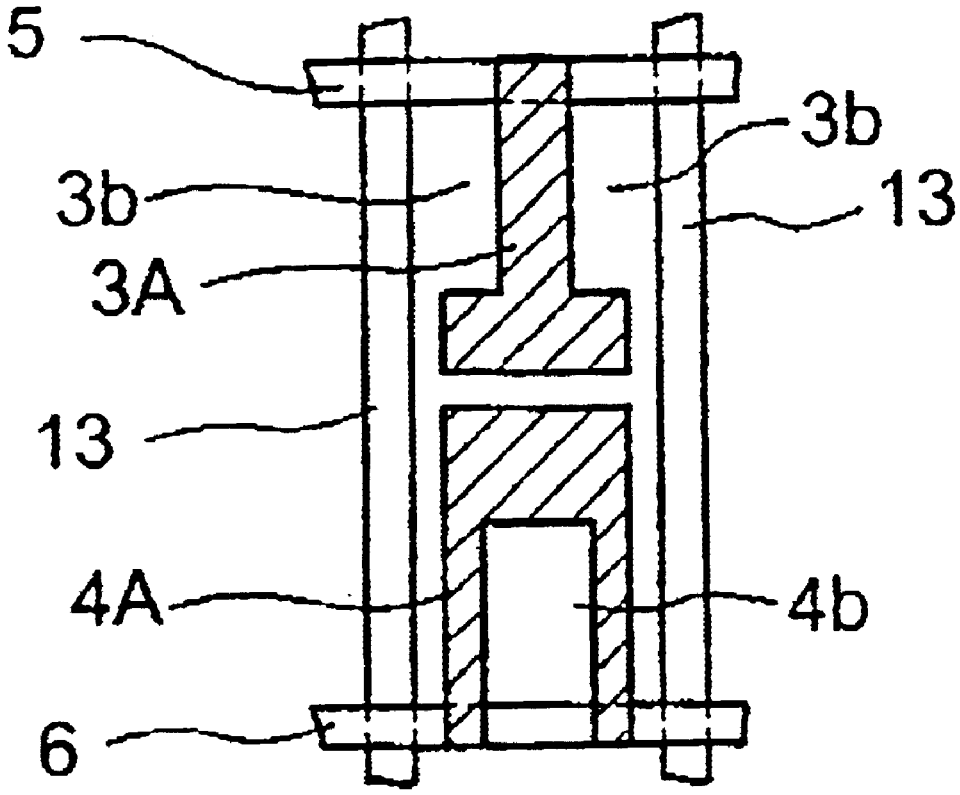
FIG. 12 is a fragmentary plane view illustrative of other examples of the respective shapes of the paired scanning and sustaining electrodes in each display cell in accordance with the present invention.

FIG. 12 is a fragmentary plane view illustrative of a first modification to the respective shapes of the paired scanning and sustaining electrodes in each display cell. In the plane view vertical to the surface of the back side insulative substrate 2, the paired scanning and sustaining electrodes 3A and 4A are positioned in a rectangle-shaped cell region which is defined by the adjacent first and second bus electrodes 5 and 6 and also by adjacent two of the separation walls 13. The paired scanning and sustaining electrodes 3A and 4A are distanced from each other by the surface discharge gap.

The scanning electrode 3A has a generally T-shaped periphery having a longitudinal axis in parallel to the separation walls 13 and in the first horizontal direction. The scanning electrode 3A has a wide part adjacent to the surface discharge gap. The scanning electrode 3A has an opposite side to the wide part adjacent to the surface discharge gap. The opposite side of the scanning electrode 3A is aligned to the first bus electrode 5.

The sustaining electrode 4A also has a rectangle-shaped periphery having a longitudinal axis in parallel to the separation walls 13 and in the first horizontal direction. The sustaining electrode 4A has a first short side adjacent to the surface discharge gap. The first short side of the sustaining electrode 4A is distanced by the surface discharge gap from the first short side of the scanning electrode 3A. The sustaining electrode 4A has an opposite side to the first short side adjacent to the surface discharge gap. The opposite side of the sustaining electrode 4A is aligned to the second bus electrode 6. The sustaining electrode 4A has a single recess 4*b* which is generally rectangle-shaped, wherein the single recess 4*b* is positioned on a longitudinal center line of the sustaining electrode 4A but extends to the opposite side than the first short side adjacent to the surface discharge gap.

The paired scanning and sustaining electrodes 3A and 4A have the same width which is defined by a size defined in the second horizontal direction along the first and second bus electrodes 5 and 6. The paired scanning and sustaining electrodes 3A and 4A have the same length which is defined by another size defined in the first horizontal direction along the separation walls 13. Respective areas of the paired scanning and sustaining electrodes 3A and 4A are approximately similar to each other, whilst the paired scanning and sustaining electrodes 3A and 4A are different in pattern shape from each other as clearly apparently from FIG. 12.

The above electrode pattern shapes shown in FIG. 12 provides the same effects as the pattern shapes shown in FIG. 10. In addition, the electrode pattern shapes shown in FIG. 12 reduces the capacitive coupling to the adjacent cell electrodes, thereby suppressing the discharge interference to the adjacent cell electrodes, and preventing erroneous light-on and light-off.

Since the scanning electrode 3A and the sustaining electrode 4A are approximately similar in area to each other, then respective discharge currents of the scanning electrode 3A and the sustaining electrode 4A are approximately similar to each other, wherein the discharge current is proportional to the area of the electrode. Since the brightness or luminance is also proportional to the discharge current, then the scanning electrode 3A and the sustaining electrode 4A are approximately similar to each other in brightness or luminance. It is possible to keep the desirable high stability of the discharge without any substantive difference between the scanning electrode 3A and the sustaining electrode 4A. Even the scanning electrode 3A and the sustaining electrode 4A are different from each other in the pattern shape, the desirable display characteristics can be obtained.

Figure 13:
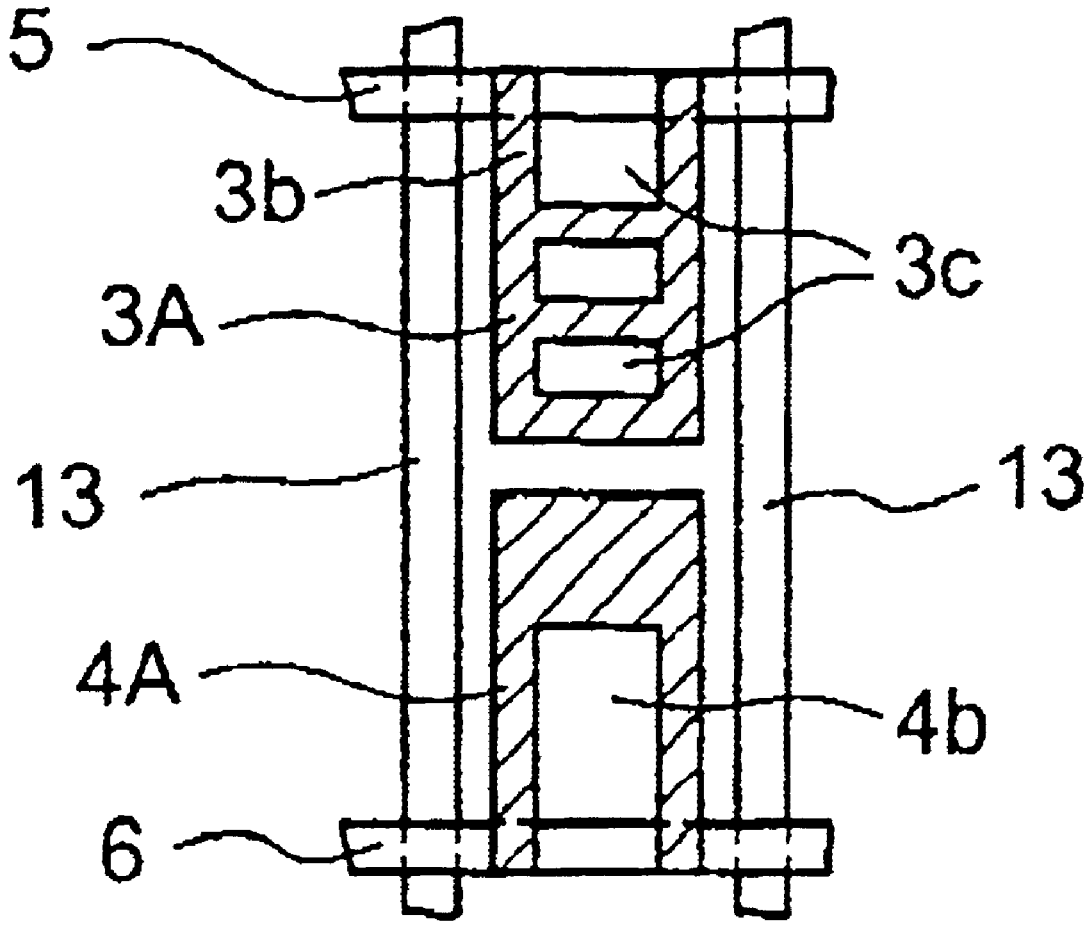
FIG. 13 is a fragmentary plane view illustrative of still other examples of the respective shapes of the paired scanning and sustaining electrodes in each display cell in accordance with the present invention.

FIG. 13 is a fragmentary plane view illustrative of the respective shapes of the paired scanning and sustaining electrodes in each display cell. In the plane view vertical to the surface of the back side insulative substrate 2, the paired scanning and sustaining electrodes 3A and 4A are positioned in a rectangle-shaped cell region which is defined by the adjacent first and second bus electrodes 5 and 6 and also by adjacent two of the separation walls 13. The paired scanning and sustaining electrodes 3A and 4A are distanced from each other by the surface discharge gap.

The scanning electrode 3A has a rectangle-shaped periphery having a longitudinal axis in parallel to the separation walls 13 and in the first horizontal direction. The scanning electrode 3A has a first short side adjacent to the surface discharge gap. The scanning electrode 3A has an opposite side to the first short side adjacent to the surface discharge gap. The opposite side of the scanning electrode 3A is aligned to the first bus electrode 5. The scanning electrode 3A has three recesses 3*c* which are generally rectangle-shaped and which are aligned in the first horizontal direction, wherein one of the three recesses 3*c* is adjacent to the opposite side to the first side adjacent to the surface discharge gap.

The sustaining electrode 4A also has a rectangle-shaped periphery having a longitudinal axis in parallel to the separation walls 13 and in the first horizontal direction. The sustaining electrode 4A has a first short side adjacent to the surface discharge gap. The first short side of the sustaining electrode 4A is distanced by the surface discharge gap from the first short side of the scanning electrode 3A. The sustaining electrode 4A has an opposite side to the first short side adjacent to the surface discharge gap. The opposite side of the sustaining electrode 4A is aligned to the second bus electrode 6. The sustaining electrode 4A has a single recess 4*b* which is generally rectangle-shaped, wherein the single recess 4*b* is positioned on a longitudinal center line of the sustaining electrode 4A but extends to the opposite side than the first short side adjacent to the surface discharge gap.

The paired scanning and sustaining electrodes 3A and 4A have the same width which is defined by a size defined in the second horizontal direction along the first and second bus electrodes 5 and 6. The paired scanning and sustaining electrodes 3A and 4A have the same length which is defined by another size defined in the first horizontal direction along the separation walls 13. Respective areas of the paired scanning and sustaining electrodes 3A and 4A are approximately similar to each other, whilst the paired scanning and sustaining electrodes 3A and 4A are different in pattern shape from each other as clearly apparently from FIG. 13.

The above electrode pattern shapes shown in FIG. 13 provides the same effects as the pattern shapes shown in FIG. 10. In addition, the electrode pattern shapes shown in FIG. 13 enhances the triggering effect for obtaining the desirably spreading sustaining discharge.

Since the scanning electrode 3A and the sustaining electrode 4A are approximately similar in area to each other, then respective discharge currents of the scanning electrode 3A and the sustaining electrode 4A are approximately similar to each other, wherein the discharge current is proportional to the area of the electrode. Since the brightness or luminance is also proportional to the discharge current, then the scanning electrode 3A and the sustaining electrode 4A are approximately similar to each other in brightness or luminance. It is possible to keep the desirable high stability of the discharge without any substantive difference between the scanning electrode 3A and the sustaining electrode 4A. Even the scanning electrode 3A and the sustaining electrode 4A are different from each other in the pattern shape, the desirable display characteristics can be obtained.

Figure 14:
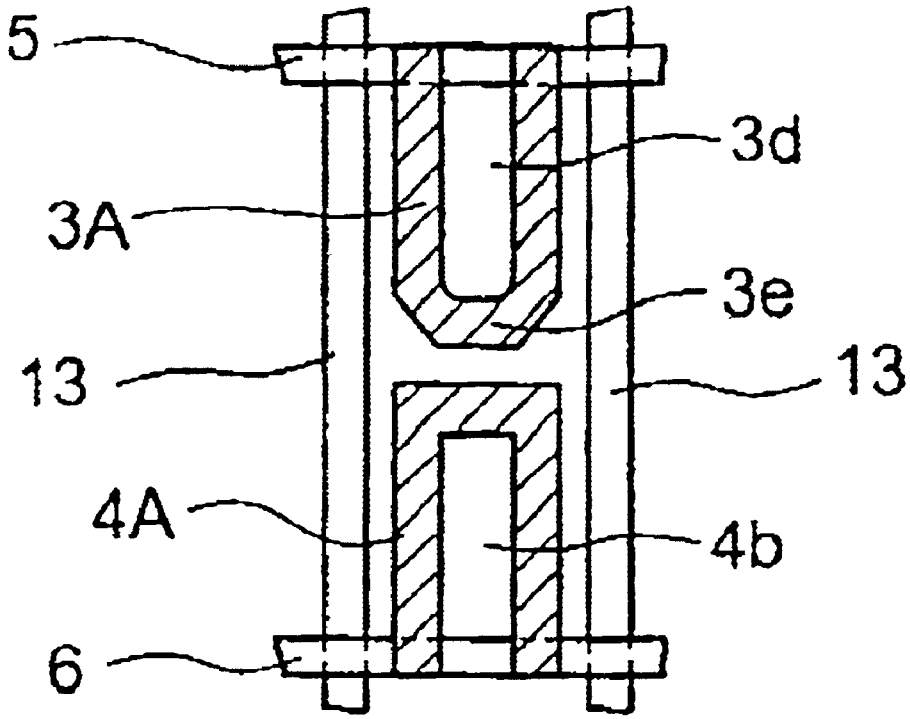
FIG. 14 is a fragmentary plane view illustrative of yet other examples of the respective shapes of the paired scanning and sustaining electrodes in each display cell in accordance with the present invention.

FIG. 14 is a fragmentary plane view illustrative of the respective shapes of the paired scanning and sustaining electrodes in each display cell. In the plane view vertical to the surface of the back side insulative substrate 2, the paired scanning and sustaining electrodes 3A and 4A are positioned in a rectangle-shaped cell region which is defined by the adjacent first and second bus electrodes 5 and 6 and also by adjacent two of the separation walls 13. The paired scanning and sustaining electrodes 3A and 4A are distanced from each other by the surface discharge gap.

The scanning electrode 3A has a generally UT-shaped periphery having a longitudinal axis in parallel to the separation walls 13 and in the first horizontal direction. The scanning electrode 3A has a closed part 3*e* adjacent to the surface discharge gap and an opened part opposite to the closed part, which are defined by a single recess 3*d* which extends from the opposite side toward the first side.

The sustaining electrode 4A also has a rectangle-shaped periphery having a longitudinal axis in parallel to the separation walls 13 and in the first horizontal direction. The sustaining electrode 4A has a first short side adjacent to the surface discharge gap. The first short side of the sustaining electrode 4A is distanced by the surface discharge gap from the first short side of the scanning electrode 3A. The sustaining electrode 4A has an opposite side to the first short side adjacent to the surface discharge gap. The opposite side of the sustaining electrode 4A is aligned to the second bus electrode 6. The sustaining electrode 4A has a single recess 4*b* which is generally rectangle-shaped, wherein the single recess 4*b* is positioned on a longitudinal center line of the sustaining electrode 4A but extends to the opposite side than the first short side adjacent to the surface discharge gap.

The paired scanning and sustaining electrodes 3A and 4A have the same width which is defined by a size defined in the second horizontal direction along the first and second bus electrodes 5 and 6. The paired scanning and sustaining electrodes 3A and 4A have the same length which is defined by another size defined in the first horizontal direction along the separation walls 13. Respective areas of the paired scanning and sustaining electrodes 3A and 4A are approximately similar to each other, whilst the paired scanning and sustaining electrodes 3A and 4A are different in pattern shape from each other as clearly apparently from FIG. 14.

The above electrode pattern shapes shown in FIG. 14 provides the same effects as the pattern shapes shown in FIG. 10. In addition, the electrode pattern shapes shown in FIG. 14 causes the opposite discharge as the write discharge between the data electrode and the closed part 3*d* of the scanning electrode 3A, thereby promoting the transition of the opposite discharge as the write discharge into the surface discharge as the sustaining discharge.

Since the scanning electrode 3A and the sustaining electrode 4A are approximately similar in area to each other, then respective discharge currents of the scanning electrode 3A and the sustaining electrode 4A are approximately similar to each other, wherein the discharge current is proportional to the area of the electrode. Since the brightness or luminance is also proportional to the discharge current, then the scanning electrode 3A and the sustaining electrode 4A are approximately similar to each other in brightness or luminance. It is possible to keep the desirable high stability of the discharge without any substantive difference between the scanning electrode 3A and the sustaining electrode 4A. Even the scanning electrode 3A and the sustaining electrode 4A are different from each other in the pattern shape, the desirable display characteristics can be obtained.

Figure 15:
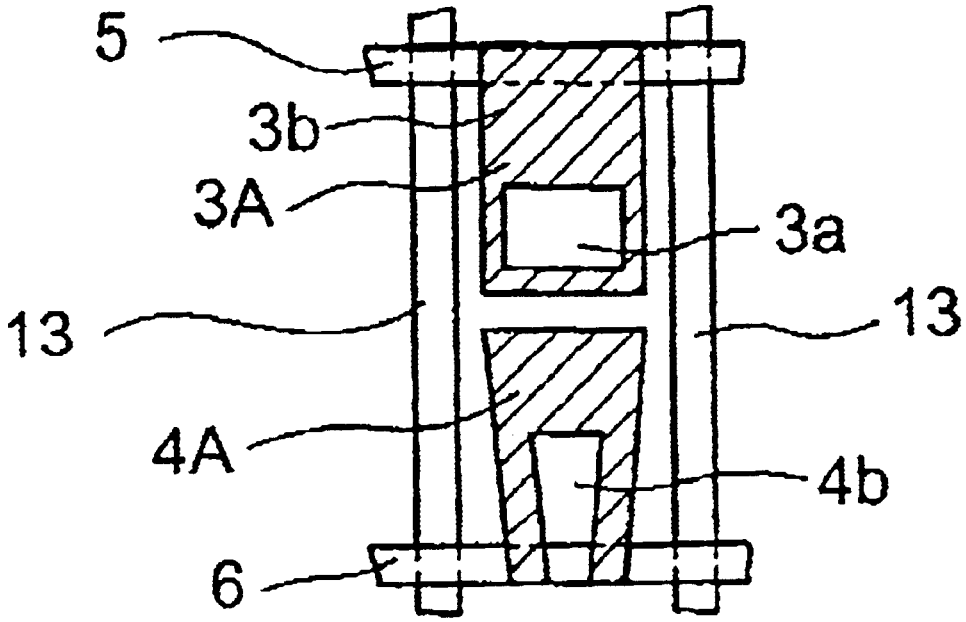
FIG. 15 is a fragmentary plane view illustrative of other examples of the respective shapes of the paired scanning and sustaining electrodes in each display cell in accordance with the present invention.

FIG. 15 is a fragmentary plane view illustrative of the respective shapes of the paired scanning and sustaining electrodes in each display cell. In the plane view vertical to the surface of the back side insulative substrate 2, the paired scanning and sustaining electrodes 3A and 4A are positioned in a rectangle-shaped cell region which is defined by the adjacent first and second bus electrodes 5 and 6 and also by adjacent two of the separation walls 13. The paired scanning and sustaining electrodes 3A and 4A are distanced from each other by the surface discharge gap.

The scanning electrode 3A has a rectangle-shaped periphery having a longitudinal axis in parallel to the separation walls 13 and in the first horizontal direction. The scanning electrode 3A has a first short side adjacent to the surface discharge gap. The scanning electrode 3A has an opposite side to the first short side adjacent to the surface discharge gap. The opposite side of the scanning electrode 3A is aligned to the first bus electrode 5. The scanning electrode 3A has a single recess 3*a* which is generally rectangle-shaped and positioned closer to the first side than the opposite side.

The sustaining electrode 4A also has a trapezoid-shaped periphery having a longitudinal axis in parallel to the separation walls 13 and in the first horizontal direction. The sustaining electrode 4A has a first short side adjacent to the surface discharge gap. The first short side of the sustaining electrode 4A is distanced by the surface discharge gap from the first short side of the scanning electrode 3A. The sustaining electrode 4A has an opposite side to the first short side adjacent to the surface discharge gap. The opposite side of the sustaining electrode 4A is aligned to the second bus electrode 6. The sustaining electrode 4A has a single recess 4*b* which is generally trapezoid-shaped, wherein the single recess 4*b* is positioned on a longitudinal center line of the sustaining electrode 4A but extends to the opposite side than the first short side adjacent to the surface discharge gap.

The scanning electrode 3A has a uniform width which is defined by a size defined in the second horizontal direction along the first and second bus electrodes 5 and 6. The sustaining electrode 4 has such a variation in width that the width is proportionally decreased from the first side to the opposite side. The paired scanning and sustaining electrodes 3A and 4A have the same length which is defined by another size defined in the first horizontal direction along the separation walls 13. Respective areas of the paired scanning and sustaining electrodes 3A and 4A are approximately similar to each other, whilst the paired scanning and sustaining electrodes 3A and 4A are different in pattern shape from each other as clearly apparently from FIG. 15.

The above electrode pattern shapes shown in FIG. 15 provides the same effects as the pattern shapes shown in FIG. 10. In addition, the electrode pattern shapes shown in FIG. 15 enhances the triggering effect for obtaining the desirably spreading sustaining discharge. The variation in width of the staining electrode 4B enhances the discharge intensity in the closer region to the surface discharge gap.

Since the scanning electrode 3A and the sustaining electrode 4A are approximately similar in area to each other, then respective discharge currents of the scanning electrode 3A and the sustaining electrode 4A are approximately similar to each other, wherein the discharge current is proportional to the area of the electrode. Since the brightness or luminance is also proportional to the discharge current, then the scanning electrode 3A and the sustaining electrode 4A are approximately similar to each other in brightness or luminance. It is possible to keep the desirable high stability of the discharge without any substantive difference between the scanning electrode 3A and the sustaining electrode 4A. Even the scanning electrode 3A and the sustaining electrode 4A are different from each other in the pattern shape, the desirable display characteristics can be obtained.

Figure 16:
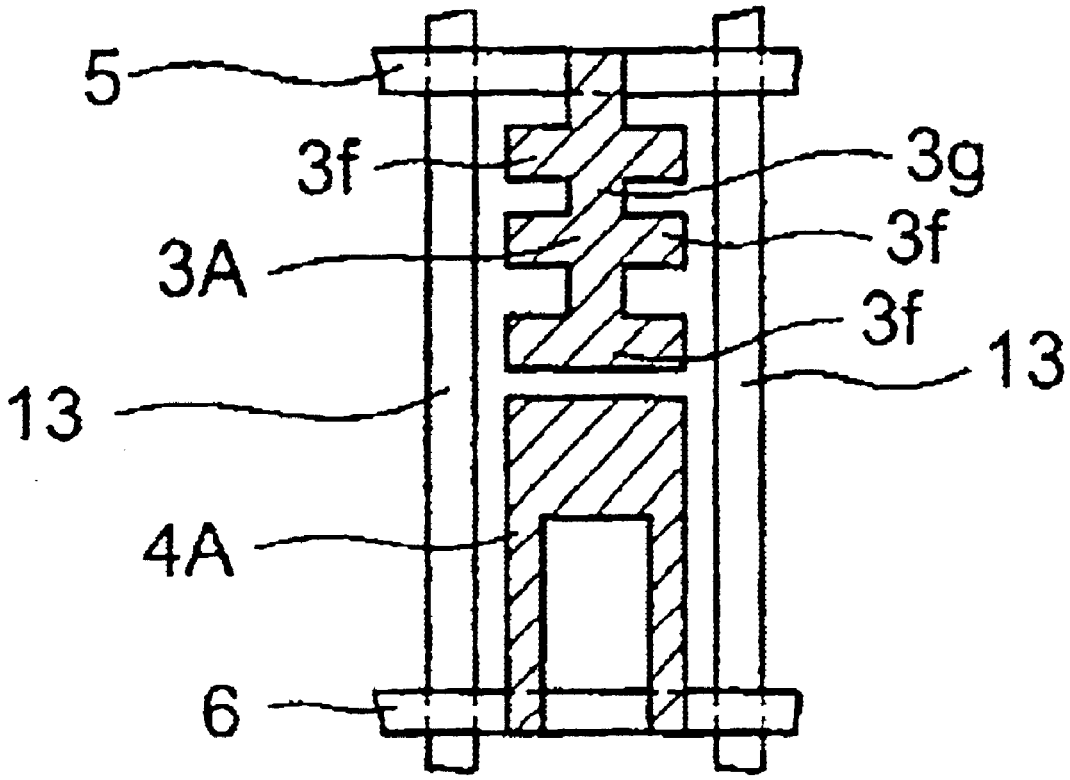
FIG. 16 is a fragmentary plane view illustrative of other examples of the respective shapes of the paired scanning and sustaining electrodes in each display cell in accordance with the present invention.

FIG. 16 is a fragmentary plane view illustrative of a first modification to the respective shapes of the paired scanning and sustaining electrodes in each display cell. In the plane view vertical to the surface of the back side insulative substrate 2, the paired scanning and sustaining electrodes 3A and 4A are positioned in a rectangle-shaped cell region which is defined by the adjacent first and second bus electrodes 5 and 6 and also by adjacent two of the separation walls 13. The paired scanning and sustaining electrodes 3A and 4A are distanced from each other by the surface discharge gap.

The scanning electrode 3A comprises a center main part 3*g* extending in a longitudinal axis in parallel to the separation walls 13 and in the first horizontal direction, and laterally extending sub-ordinate parts 3*f* which extend from the center main part in opposite directions parallel to the second horizontal direction.

The sustaining electrode 4A also has a rectangle-shaped periphery having a longitudinal axis in parallel to the separation walls 13 and in the first horizontal direction. The sustaining electrode 4A has a first short side adjacent to the surface discharge gap. The first short side of the sustaining electrode 4A is distanced by the surface discharge gap from the first short side of the scanning electrode 3A. The sustaining electrode 4A has an opposite side to the first short side adjacent to the surface discharge gap. The opposite side of the sustaining electrode 4A is aligned to the second bus electrode 6. The sustaining electrode 4A has a single recess 4*b* which is generally rectangle-shaped, wherein the single recess 4*b* is positioned on a longitudinal center line of the sustaining electrode 4A but extends to the opposite side than the first short side adjacent to the surface discharge gap.

The paired scanning and sustaining electrodes 3A and 4A have the same width which is defined by a size defined in the second horizontal direction along the first and second bus electrodes 5 and 6. The paired scanning and sustaining electrodes 3A and 4A have the same length which is defined by another size defined in the first horizontal direction along the separation walls 13. Respective areas of the paired scanning and sustaining electrodes 3A and 4A are approximately similar to each other, whilst the paired scanning and sustaining electrodes 3A and 4A are different in pattern shape from each other as clearly apparently from FIG. 16.

The above electrode pattern shapes shown in FIG. 16 provides the same effects as the pattern shapes shown in FIG. 10.

Since the scanning electrode 3A and the sustaining electrode 4A are approximately similar in area to each other, then respective discharge currents of the scanning electrode 3A and the sustaining electrode 4A are approximately similar to each other, wherein the discharge current is proportional to the area of the electrode. Since the brightness or luminance is also proportional to the discharge current, then the scanning electrode 3A and the sustaining electrode 4A are approximately similar to each other in brightness or luminance. It is possible to keep the desirable high stability of the discharge without any substantive difference between the scanning electrode 3A and the sustaining electrode 4A. Even the scanning electrode 3A and the sustaining electrode 4A are different from each other in the pattern shape, the desirable display characteristics can be obtained.

Although the invention has been described above in connection with several preferred embodiments therefor, it will be appreciated that those embodiments have been provided solely for illustrating the invention, and not in a limiting sense. Numerous modifications and substitutions of equivalent materials and techniques will be readily apparent to those skilled in the art after reading the present application, and all such modifications and substitutions are expressly understood to fall within the true scope and spirit of the appended claims.

What is claimed is:

1. A plasma display panel comprising:

a first substrate having a first inside face;

a second substrate having a second inside face which confronts said first inside face of said first substrate;

a plurality of data electrodes extending over said second inside face of said second substrate in a first horizontal direction;

a plurality of separation walls extending over said second inside face of said second substrate in said first horizontal direction, and each of said separation walls separating adjacent two of said data electrodes;

a plurality of scanning electrode alignments extending over said first inside face of said first substrate in a second horizontal direction;

a plurality of sustaining electrode alignments extending over said second inside face of said second substrate in said second horizontal direction; and said scanning electrode alignments and said sustaining electrode alignments being alternately placed in said first horizontal direction, wherein each of said scanning electrode alignments further includes a plurality of scanning electrodes which are aligned with a predetermined constant gap in said second horizontal direction, and which are electrically connected to each other through a first electrode interconnection, and adjacent two of said scanning electrodes included in each of said scanning electrode alignments are separated from each other by said separation wall, wherein each of said sustaining electrode alignments further includes a plurality of sustaining electrodes which are aligned with said predetermined constant gap in said second horizontal direction, and said sustaining electrodes being electrically connected to each other through a second electrode interconnection, and adjacent two of said sustaining electrodes included in each of said scanning electrode alignments are also separated from each other by said separation wall, and wherein said plasma display panel includes a two-dimensional array of cells, and each of said cells includes a pair of said sustaining electrode and said scanning electrode, and said paired sustaining and scanning electrodes are distanced by a surface discharge gap, and are asymmetrically shaped with respect to each other about said surface discharge gap.

2. The plasma display panel as claimed in claim 1, wherein respective areas of said paired sustaining and scanning electrodes are approximately similar or equal to each other, whilst respective pattern shapes of said paired sustaining and scanning electrodes are different from each other.

3. The plasma display panel as claimed in claim 2, wherein each of said sustaining electrodes comprises a first half part closer to a first side adjacent to said surface discharge gap bounding said paired sustaining and scanning electrodes, and a second half part adjacent to a second side opposite to said first side, and said first and second half parts are bounded by a boundary which is positioned at an intermediate between said first and second sides, and said first half part is larger in area than said second half part.

4. The plasma display panel as claimed in claim 3, wherein said pattern shape of each of said sustaining electrodes is symmetrical with reference to the second horizontal direction, and asymmetrical with reference to the first horizontal direction.

5. The plasma display panel as claimed in claim 4, wherein said pattern shape of each of said sustaining electrodes has a recess, a majority of which extends in the second half part.

6. The plasma display panel as claimed in claim 5, wherein said pattern shape of each of said sustaining electrodes has a uniform size defined in said second horizontal direction over positions in the first horizontal direction.

7. The plasma display panel as claimed in claim 5, wherein said pattern shape of each of said sustaining electrodes has a decrease in width defined in said second horizontal direction from said first side to said second side.

8. The plasma display panel as claimed in claim 3, wherein each of said scanning electrodes comprises a first half part closer to a first side adjacent to said surface discharge gap bounding said paired sustaining and scanning electrodes, and a second half part adjacent to a second side opposite to said first side, and said first and second half parts are bounded by a boundary which is positioned at an intermediate between said first and second sides, and said first half part of said sustaining electrode is larger in area than said first half part of said scanning electrode.

9. The plasma display panel as claimed in claim 2, wherein each of said sustaining electrodes comprises a first half part closer to a first side adjacent to said surface discharge gap bounding said paired sustaining and scanning electrodes, and a second half part adjacent to a second side opposite to said first side, and said first and second half parts are bounded by a boundary which is positioned at an intermediate between said first and second sides, and wherein each of said scanning electrodes comprises a first half part closer to a first side adjacent to said surface discharge gap bounding said paired sustaining and scanning electrodes, and a second half part adjacent to a second side opposite to said first side, and said first and second half parts are bounded by a boundary which is positioned at an intermediate between said first and second sides, and said first half part of said sustaining electrode is larger in area than said first half part of said scanning electrode.

10. The plasma display panel as claimed in claim 2, wherein each of said scanning electrodes has a pattern shape which causes a field concentration at a position closer to a first side adjacent to said surface discharge gap than a second side opposite to said first side.

11. The plasma display panel as claimed in claim 2, wherein said pattern shape of each of said scanning electrodes has a recess which extends closer to said first side than said second side.

12. The plasma display panel as claimed in claim 2, wherein said pattern shape of each of said scanning electrodes is a generally T-shape including a side portion closer to said surface discharge gap.

13. The plasma display panel as claimed in claim 2, wherein said pattern shape of each of said scanning electrodes has a plurality of recesses which are aligned in said first horizontal direction.

14. The plasma display panel as claimed in claim 2, wherein said pattern shape of each of said scanning electrodes is a generally U-shape having a closing side adjacent to said surface discharge gap and an opening side opposite to said closing side.

15. The plasma display panel as claimed in claim 2, wherein said pattern shape of each of said scanning electrodes comprises a center main part extending in said first horizontal direction and a plurality of sub-ordinate parts extending from said center main part toward opposite directions parallel to said second horizontal directions.

16. The plasma display panel as claimed in claim 1, wherein each said cells is defined by said first and second electrode interconnections and adjacent two of said separation walls.

17. The plasma display panel as claimed in claim 1, wherein said first and second electrode interconnections comprise first and second bus electrodes respectively.

18. A cell electrode structure of a plasma display panel, said cell surface electrode structure including; a pair of sustaining and scanning electrodes which are approximately similar or equal in area to each other, and which are different from each other in pattern shape so as to be asymmetrical with respect to each other.

19. The cell electrode structure as claimed in claim 18, wherein said paired sustaining and scanning electrodes are interposed between adjacent two of separation walls extending in a first horizontal direction, and said paired sustaining and scanning electrodes are separated from each other by a surface discharge gap in said first horizontal direction.

20. The cell electrode structure as claimed in claim 19, wherein each of said sustaining electrodes comprises a first half part closer to a first side adjacent to said surface discharge gap bounding said paired sustaining and scanning electrodes, and a second half part adjacent to a second side opposite to said first side, and said first and second half parts are bounded by a boundary which is positioned at an intermediate between said first and second sides, and said first half part is larger in area than said second half part.

21. The cell electrode structure as claimed in claim 20, wherein said pattern shape of each of said sustaining electrodes is symmetrical with reference to the second horizontal direction, and asymmetrical with reference to the first horizontal direction.

22. The cell electrode structure as claimed in claim 21, wherein said pattern shape of each of said sustaining electrodes has a recess, a majority of which extends in the second half part.

23. The cell electrode structure as claimed in claim 22, wherein said pattern shape of each of said sustaining electrodes has a uniform size defined in said second horizontal direction over positions in the first horizontal direction.

24. The cell electrode structure as claimed in claim 22, wherein said pattern shape of each of said sustaining electrodes has a decrease in width defined in said second horizontal direction from said first side to said second side.

25. The cell electrode structure as claimed in claim 20, wherein each of said scanning electrodes comprises a first half part closer to a first side adjacent to said surface discharge gap bounding said paired sustaining and scanning electrodes, and a second half part adjacent to a second side opposite to said first side, and said first and second half parts are bounded by a boundary which is positioned at an intermediate between said first and second sides, and said first half part of said sustaining electrode is larger in area than said first half part of said scanning electrode.

26. The cell electrode structure as claimed in claim 18, wherein each of said sustaining electrodes comprises a first half part closer to a first side adjacent to said surface discharge gap bounding said paired sustaining and scanning electrodes, and a second half part adjacent to a second side opposite to said first side, and said first and second half parts are bounded by a boundary which is positioned at an intermediate between said first and second sides, and wherein each of said scanning electrodes comprises a first half part closer to a first side adjacent to said surface discharge gap bounding said paired sustaining and scanning electrodes, and a second half part adjacent to a second side opposite to said first side, and said first and second half parts are bounded by a boundary which is positioned at an intermediate between said first and second sides, and said first half part of said sustaining electrode is larger in area than said first half part of said scanning electrode.

27. The cell electrode structure as claimed in claim 18, wherein each of said scanning electrodes has a pattern shape which causes a field concentration at a position closer to a first side adjacent to said surface discharge gap than a second side opposite to said first side.

28. The cell electrode structure as claimed in claim 18, wherein said pattern shape of each of said scanning electrodes has a recess which extends closer to said first side than said second side.

29. The cell electrode structure as claimed in claim 18, wherein said pattern shape of each of said scanning electrodes is a generally T-shape including a wide portion closer to said surface discharge gap.

30. The cell electrode structure as claimed in claim 18, wherein said pattern shape of each of said scanning electrodes has a plurality of recesses which are aligned in said first horizontal direction.

31. The cell electrode structure as claimed in claim 18, wherein said pattern shape of each of said scanning electrodes is a generally U-shape having a closing side adjacent to said surface discharge gap and an opening side opposite to said closing side.

32. The cell electrode structure as claimed in claim 18, wherein said pattern shape of each of said scanning electrodes comprises a center main part extending in said first horizontal direction and a plurality of sub-ordinate parts extending from said center main part toward opposite directions parallel to said second horizontal directions.

33. The cell electrode structure as claimed in claim 18, wherein each said cells is defined by said first and second electrode interconnections and adjacent two of said separation walls.

34. The cell electrode structure as claimed in claim 18, wherein said first and second electrode interconnections comprise first and second bus electrodes respectively.

* * * * *

UNITED STATES PATENT AND TRADEMARK OFFICE

CERTIFICATE OF CORRECTION

PATENT NO. : 6,703,772 B2
DATED : March 9, 2004
INVENTOR(S) : Hiroshi Hasegawa et al.

It is certified that error appears in the above-identified patent and that said Letters Patent is hereby corrected as shown below:

Column 2,
Line 22, delete “defied”, and insert -- defined --.

Column 10,
Line 64, delete “pan”, and insert -- part --.

Column 13,
Lines 24-25, delete “still another single pair of the scanning electrode 3C and the sustaining electrode 4C.”, and insert -- another single pair of the scanning electrode 3B and the sustaining electrode 4B. Still another display cell includes still another single pair of the scanning electrode 3C and the sustaining electrode 4C. --.

Signed and Sealed this

Twenty-second Day of November, 2005

JON W. DUDAS
*Director of the United States Patent and Trademark Office*